US005091295A

United States Patent [19]

Kuwashima et al.

[11] Patent Number: 5,091,295

[45] Date of Patent: Feb. 25, 1992

[54] COLOR PHOTOGRAPHIC MATERIAL AND METHOD OF FORMING COLOR IMAGE

[75] Inventors: Shigeru Kuwashima; Mario Aoki, both of Kanagawa, Japan

[73] Assignee: Fuji Photo Film Co., Ltd., Kanagawa, Japan

[21] Appl. No.: 585,840

[22] Filed: Sep. 20, 1990

[30] Foreign Application Priority Data

Sep. 20, 1989 [JP] Japan ..... 1-244652

[51] Int. Cl.[5] ..... G03C 1/40

[52] U.S. Cl. ..... 430/507; 430/512; 430/517; 430/522; 430/574; 430/576; 430/592; 430/940

[58] Field of Search ..... 430/507, 510, 512, 517, 430/522, 574, 576, 581, 504, 506, 591, 592, 593, 547, 589, 940

[56] References Cited

U.S. PATENT DOCUMENTS

| | | | |
|---|---|---|---|
| 3,379,533 | 4/1968 | Jenkins et al. | 430/578 |
| 4,880,726 | 11/1989 | Shiba et al. | 430/551 |
| 4,935,337 | 6/1990 | Kuwashima et al. | 430/522 |
| 4,956,269 | 9/1990 | Ikeda et al. | 430/507 |

FOREIGN PATENT DOCUMENTS

| | | |
|---|---|---|
| 133051 | 4/1989 | European Pat. Off. . |
| 62-160449 | 7/1987 | Japan . |
| 183652 | 7/1989 | Japan . |

OTHER PUBLICATIONS

Patent Abstracts of Japan, vol. 12, No. 210 (P-717) (3047), Jun. 16, 1988, abstracting JP-A-63 8741, Jan. 14, 1988.

Patents Abstracts of Japan, vol. 13, No. 467 (P-948) (3815), Oct. 23, 1989, abstracting JP-A-1 183652, Jul. 12, 1989.

*Primary Examiner*—Hoa V. Le

*Attorney, Agent, or Firm*—Sughrue, Mion, Zinn, Macpeak & Seas

[57] ABSTRACT

'A positive-positive silver halide color photographic material comprising at least one red-sensitive silver halide emulsion layer, at least one green-sensitive silver halide emulsion layer, at least one blue-sensitive silver halide emulsion layer, at least one hydrophilic colloid layer, and at least one colloidal silver layer on a support wherein said silver halide emulsion layer, hydrophilic colloid layer, or colloidal silver layer contains at least one dye of formula (I):

(I)

where $R_1$, $R_2$, $R_3$ and $R_4$ are the same or different and each represents an alkyl group, an aryl gorup or a heterocyclic group; $L_1$, $L_2$ and $L_3$ each represents a methine group; $n_1$ represents 1 or 2; and any of $R_1$, $R_2$, $R_3$ and $R_4$ has a sulfo group and the total of the groups is at least two or more. A method of forming a color image using the same is also disclosed.

4 Claims, No Drawings

COLOR PHOTOGRAPHIC MATERIAL AND METHOD OF FORMING COLOR IMAGE

FIELD OF THE INVENTION

The present invention relates to a positive-positive silver halide color photographic material which is used for obtaining a color positive image from a color positive original and a method of forming a color image using the same. More precisely, it relates to a positive-positive silver halide color photographic material that has improved color reproducibility and white background reproducibility and that gives an image free from stain and a method of forming a color image using the same.

BACKGROUND OF THE INVENTION

A silver halide color photographic material generally has a number of silver halide emulsion layers each of which is sensitive to one of the three primary colors, blue, green or red. In the material, the respective layers are colored yellow, magenta or cyan and reproduce a color image by a so-called subtractive color process.

Accordingly, the color image to be reproduced is influenced by the wavelength range to which the respective layers are sensitive (spectral sensitivity distribution) and, in addition, noticeably depends upon the yellow, magenta and cyan color hues formed in the respective layers, or upon the spectral absorption characteristics of the colored dyes in the layers. In general, the characteristics are variously limited by the raw materials used to prepare the photographic material and do not sufficiently satisfy the theoretical ideal system.

With respect to the problem of the spectral sensitivity distribution, various new sensitizing dyes have been developed to improve the spectral sensitivity distribution. In addition, it is known that even when the same sensitizing dye is used, the spectral sensitivity distribution of the photographic material can vary, depending upon the characteristics of the silver halide emulsions used as well as the condition for adsorbing the sensitizing dye to silver halides. For example, JP-A-61-103149 and JP-A-61-133941 (the term "JP-A" as used herein means an "unexamined published Japanese patent application") disclose that the addition of a sensitizing dye to a silver halide emulsion during the preparation of an emulsion results in a photographic material having excellent spectral sensitivity.

It is also known that the spectral sensitivity distribution is influenced by the dyes used in the photographic material. Such dyes are generally anti-irradiation dyes or anti-halation dyes, which are used to improve the sharpness of photographic materials. Examples of such dyes are the oxonole dyes, the azo dyes, and the anthraquinone dyes. In selecting such dyes, special attention must be taken to avoid dyes that negatively influence on the photographic properties of the photographic materials. Such dyes are known to negatively influence photographic materials, for example, by causing deterioration in the storability of raw films, by causing deterioration of the white background portion of processed films due to insufficient discoloration and dissolution of the dyes during processing, by staining the color images formed due to the retardation of the desilvering speed, by causing an acceleration of latent image fading, by lowering sensitivity, and by increasing fog.

For example, JP-A-52-20830 discloses a color photographic material containing a water-soluble bispyrazolonepentamethineoxonole dye having a spectral absorption maximum in the wavelength range of from 580 to 630 nm. Using this dye, the spectral sensitivity distribution of the red-sensitive layer or the green-sensitive layer in the material is improved and therefore the material has improved color reproducibility. However, this dye interferes with the spectral sensitization of the material; decreases the storability of the material; and the color of the dye often remains in the image formed after processing of the material.

JP-A-51-1419 discloses incorporation of a bispyrazolonemonomethineoxonole dye which has an absorption maximum in a shorter wavelength range than 440 nm. Such dye can absorb a short wavelength blue light falling within the range of from 390 to 440 nm. Also incorporation is a bispyrazolonetrimethineoxonole dye having an absorption maximum in the range of from 460 to 520 nm. The inclusion of both dyes improved the spectral sensitivity distribution of the blue-sensitive emulsion layer of the material. However, the dyes also interfere with the spectral sensitization of the material and worsen the storability of the material. In addition, the color of these dyes often remains in the image formed in the processed material.

JP-A-1-106047 discloses a positive-positive silver halide color photographic material which contains a new hydroxy/pyridoneoxonole dye and which has improved color reproducibility due to the addition of this dye. In accordance with the method, an optimum spectral sensitivity of a positive-positive silver halide material is realized, as well as the fact that the color of the dye added does not remain in the color image formed after processing. However, the quality of the processing bath, particularly the bath in which bleaching takes place, is decreased by the dye so that the desilvering of the material being processed is deteriorated and, as a result, the quality of the white background portion in the image formed also decreases. This is particularly noticeable when the positive-positive silver halide color photographic material contains a colloidal silver.

Generally, a conventional positive-positive silver halide photographic material uses a yellow colloidal silver layer as a yellow filter layer to improve color reproducibility. If there is a yellow filter layer, a blue-sensitive layer does not color in a positive-positive silver halide photographic material when exposed to blue light, then a green-sensitive layer and a red-sensitive layer are colored to magenta and cyan, respectively. On the other hand, if there is no yellow filter layer, a green-sensitive layer and a red-sensitive layer, in addition to a blue-sensitive layer, are sensitized, resulting in insufficient magenta and cyan color formation, then blue color formation becomes insufficient.

It has been known that the presence of such a colloidal silver layer tends to cause insufficient desilvering and worsen white portions. JP-A-63-159847 proposes to improve this problem.

The insufficient desilvering due to a colloidal silver is largely influenced by not only properties of the colloidal silver (size, form, distribution, etc.) but also other additives in a photographic material. The dyes which has been discussed above are an example of such an additive which influences on insufficient desilvering due to a colloidal silver.

Various additives have been studied and used for accelerating the bleaching and for preventing the insufficient desilvering of processed photographic materials.

For instance, to this end a variety of compounds are known, such as various mercapto compounds as described in U.S. Pat. No. 3,893,858, British Patent 1,388,425 and JP-A-53-141623; disulfido bond-having compounds described in JP-A-53-95630; thiazolidine derivatives described in JP-B-53-9854 (the term "JP-B" as used herein means an "examined Japanese patent publication); isothiourea derivatives described in JP-A-53-94927; thiourea derivatives described in JP-B 45-8506 and JP-B-49-26586; thioamide compounds described in JP-A-49-42349; and dithiocarbamic acid salts described in JP-A-55-26506.

JP-A-63-8741 discloses an effective bleaching accelerator for positive emulsions.

But even when such a bleaching accelerator is used, there is a case where bleaching acceleration is insufficient depending on the structure of a photographic material. In the hydroxy/pyridoneoxonole dye of JP-A-1-106047 discussed above, even though such a bleaching accelerator is used, insufficient desilvering due to deterioration of a bath has not fully improved.

The followings are positive-positive silver halide color photographic materials that give a color positive image from a color positive original, for example, color reversal films, color duplicating films and color reversal papers for a reversal processing system; autopositive color films and autopositive color papers for an autopositive processing system; and instant films and diffusion transfer type dry color papers for diffusion transfer processing systems. However, in such positive-positive silver halide color photographic materials, it is difficult to plan the spectral sensitivity distribution because the color positive originals are so diverse.

The problems inherent with positive-positive silver halide color photographic materials are not solved sufficiently by any of the above described methods. In addition, originals that are to be duplicated using positive-positive silver halide photographic materials often contain white paper areas or transparent film areas. Reproducibility of the white part and the transparent part is one important characteristic of positive-positive photographic materials. Thus, dramatic improvement is possible by removing as much as of the stain caused by remaining dyes or remaining silver.

In particular, remaining silver in processed positive-positive silver halide photographic materials having an yellow-filter (YF) colloidal silver layer is frequent, and removing this is important.

SUMMARY OF THE INVENTION

An object of the present invention is to provide a positive-positive silver halide color photographic material that has improved color reproducibility and can faithfully reproduce the saturation and color hue of a color positive original as a color positive image and a method of forming a color image using the same.

Another object of the present invention is to provide a positive-positive silver halide color photographic material, which has improved white portion and in which the dyes and silver that are a part of the non-processed photographic material do not remain as part of the processed material and a method of forming a color image using the same.

Yet another object of the present invention is to provide a positive-positive silver halide color photographic material having excellent color reproducibility that can be effectively processed using a bleaching accelerator and that remains free of image stains caused by the silver remaining in the processed material and a method of forming a color image using the same.

Still another object of the present invention is to provide a positive-positive silver halide color photographic material having excellent color reproducibility which contains a colloidal silver and is free from image stains caused by the silver remaining in the processed material and a method of forming a color image using the same.

The above-mentioned object of the present invention have been attained by a positive-positive silver halide color photographic material and a method of forming a color image as below:

(1) A positive positive silver halide color photographic material comprising at least one red-sensitive silver halide emulsion layer, at least one green-sensitive silver halide emulsion layer, at least one blue-sensitive silver halide emulsion layer, at least one hydrophilic colloid layer, and at least one colloidal silver layer on a support wherein said silver halide emulsion layer, hydrophilic colloid layer, or colloidal silver layer contains at least one dye of formula (I):

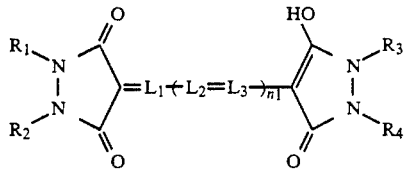

(I)

where $R_1$, $R_2$, $R_3$ and $R_4$ are the same or different and each represents an alkyl group, an aryl group or a heterocyclic group; $L_1$, $L_2$ and $L_3$ each represents a methine group; $n_1$ represents 1 or 2; and any of $R_1$, $R_2$, $R_3$ and $R_4$ has a sulfo group and the total of the groups is at least two or more.

(2) The positive-positive silver halide color photographic material as Item (1) above, which further contains a compound of formula (IX):

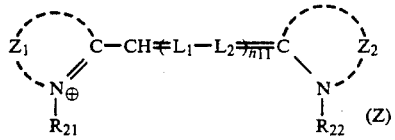

(IX)

(Z)

where $Z_1$ and $Z_2$ are the same represents an atomic group necessary for forming a benzothiazole nucleus, a naphthothiazole nucleus, a benzoselenazole nucleus or a naphthoselenazole nucleus; $R_{21}$ and $R_{22}$ are the same or different and each represents an alkyl group, provided that at least one Of $R_{21}$ and $R_{22}$ has a sulfo group or a carboxyl group; $L_1$ and $L_2$ are each represents a methine group; $n_{11}$ represents 0, 1 or 2; and Z represents a group for necessary for satisfying the charge balance of the compound of the formula, and when the compound has no Z, it forms an internal salt.

(3) The positive-positive silver halide color photographic material as Item (1) above, wherein the following relationship is satisfied:

$$(\lambda_{smax-0.1})-(\lambda_{smax-0.6})<30 \text{ nm}$$

where $\lambda_{smax}$ represents a wavelength at the spectral maximum sensitivity, Smax, in the red-sensitive emulsion layer, $\lambda_{smax-0.1}$ represents a wavelength in the short wavelength side in which the sensitivity is lower than that of $\lambda_{smax}$ by 0.1, and $\lambda_{smax-0.6}$ represents a wavelength in the short wavelength side in which the sensitivity is lower than that of $\lambda_{smax}$ by 0.6.

(4) The positive-positive silver halide color photographic material as Item (3) above, wherein the relationship is $(\lambda_{smax-0.1})-(\lambda_{smax-0.6})<20$ nm.

(5) A method of forming a color image, which comprises processing a positive-positive silver halide color photographic material comprising at least one red-sensitive silver halide emulsion layer, at least one green-sensitive silver halide emulsion layer, at least one blue-sensitive silver halide emulsion layer, at least one hydrophilic colloid layer, and at least one colloidal silver layer on a support wherein said silver halide emulsion layer, hydrophilic colloid layer, or colloidal silver layer contains at least one dye of formula (I):

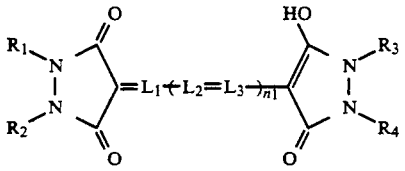

(I)

where $R_1$, $R_2$, $R_3$ and $R_4$ are the same or different and each represents an alkyl group, an aryl group or a heterocyclic group; $L_1$, $L_2$ and $L_3$ each represents a methine group; $n_1$ represents 1 or 2; and any of $R_1$, $R_2$, $R_3$ and $R_4$ has a sulfo group and the total of the groups is at least two or more:

by a processing bath having a bleaching capacity which contains at least one compound of formulae (II) to (VIII) or a pre-bath thereof:

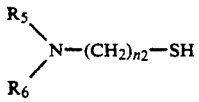

(II)

where $R_5$ and $R_6$ are the same or different and each represents a hydrogen atom, a lower alkyl, or an acyl group; $n_2$ represents 1, 2 or 3; and $R_5$ and $R_6$ may be bonded to each other to form a ring;

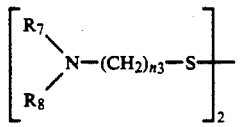

(III)

where $R_7$ and $R_8$ have the same meanings as $R_5$ and $R_6$ in the formula (II); $n_3$ represents 1, 2 or 3; and $R_7$ and $R_8$ may be bonded to each other to form a ring;

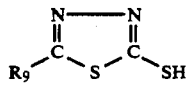

(IV)

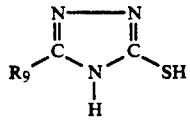

(V)

-continued

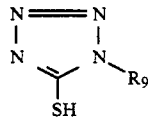

(VI)

where $R_9$ represents a hydrogen atom, a halogen atom, an amino group, a lower alkyl group, or an alkyl group-having amino group;

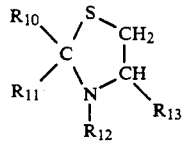

(VII)

where $R_{10}$ and $R_{11}$ may be the same or different and each represents a hydrogen atom, an alkyl group, a phenyl group, or a heterocyclic group; $R_{12}$ represents a hydrogen atom, or a lower alkyl group; and $R_{13}$ represents a hydrogen atom or a carboxyl group; and

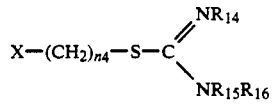

(VIII)

where $R_{14}$, $R_{15}$ and $R_{16}$ may be the same or different and each represents a hydrogen atom or a lower alkyl group; $R_{14}$ and $R_{15}$ or $R_{16}$ may be bonded to each other to form a ring; and X represents an amino group, a sulfonic acid group, or a carboxyl group.

(6) The method of forming a color image as Item (5) above, wherein said photographic material further contains a compound of formula (IX):

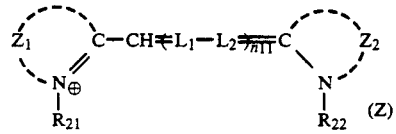

(IX)

(Z)

where $Z_1$ and $Z_2$ are the same or different and each represents an atomic group necessary for forming a benzothiazole nucleus, a naphthothiazole nucleus, a benzoselenazole nucleus or a naphthoselenazole nucleus; $R_{21}$ and $R_{22}$ are the same or different and each represents an alkyl group, provided that at least one of $R_{21}$ and $R_{22}$ has a sulfo group or a carboxyl group; $L_1$ and $L_2$ are each represents a methine group; $n_{11}$ represents 0, 1 or 2; and Z represents a group for necessary for satisfying the charge balance of the compound of the formula, and when the compound has no Z, it forms an internal salt.

(7) The method of forming a color image as Item (5) above, wherein said photographic material satisfies the following relationship: the positive-positive silver halide color photographic material as Item (1) above, wherein the following relationship is satisfied:

$$(\lambda_{smax-0.1})-(\lambda_{smax-0.6})<30 \text{ nm}$$

where $\lambda_{smax}$ represents a wavelength at the spectral maximum sensitivity, Smax, in the red-sensitive emulsion layer, $\lambda_{smax-0.1}$ represents a wavelength in the short wavelength side in which the sensitivity is lower than that of $\lambda_{smax}$ by 0.1, and $\lambda_{smax-0.6}$ represents a wavelength in the short wavelength side in which the sensitivity is lower than that of $\lambda_{smax}$ by 0.6.

(8) The method of forming a color image as Item (7) above, wherein the positive-positive silver halide color photographic material as Item (3) above, wherein the relationship is $(\lambda_{smax-0.1})-(\lambda_{smax-0.6})<20$ nm.

DETAILED DESCRIPTION OF THE INVENTION

The dyes of the formula (I) which are employed in the present invention are explained in detail below.

In the dyes of the formula (I), the substituents $R_1$, $R_2$, $R_3$ and $R_4$ are the same or different and each preferably represents an alkyl group (for example, having from 1 to 12 carbon atoms, such as methyl, ethyl, butyl, octyl, dodecyl); a substituted alkyl group (for example, an alkyl group which has from 1 to 12 carbon atoms and which is substituted by substituent(s) selected from a sulfo group (e.g., sulfomethyl, sulfoethyl, sulfobutyl), a carboxyl group (e.g., carboxymethyl, carboxyethyl), a hydroxyl group (e.g., hydroxyethyl, hydroxypropyl), an alkoxy group having from 1 to 10 carbon atoms (e.g., methoxyethyl, ethoxyethyl), a halogen atom such as fluorine, chlorine or bromine atom (e.g., 2-chloroethyl, 2,2,2-trifluoroethyl), a cyano group (e.g., 2-cyanoethyl), a sulfonyl group (e.g., methanesulfonylethyl), a nitro group (e.g., 2-nitrobutyl), an amino group (e.g., dimethylaminoethyl, diethylaminopropyl), and an aryl group having from 6 to 10 carbon atoms which may optionally have substituent(s) of a halogen atom, a sulfo group, a carboxyl group, an alkyl group, an alkoxy group, a cyano group, a nitro group, an amino group, a sulfonyl group, an alkoxycarbonyl group, an acyl group, a carbamoyl group, a sulfamoyl group and/or an acylamino group (e.g., benzyl, p-chlorobenzyl, o-sulfobenzyl, o-, p-disulfobenzyl, p-hydroxybenzyl, p-methoxybenzyl, p-dimethylaminobenzyl, p-sulfophenylethyl)); an aryl group (for example, having from 6 to 10 carbon atoms, such as phenyl, naphthyl); a substituted aryl group (for example, an aryl group which has from 6 to 10 carbon atoms and which is substituted by substituent(s) selected from a sulfo group (e.g., p-sulfophenyl, 2,5-disulfophenyl, 4-sulfonaphthyl), a carboxyl group (e.g., p-carboxyphenyl, m-carboxylphenyl), a hydroxyl group (e.g., p-hydroxyphenyl), an alkoxy group having from 1 to 10 carbon atoms (e.g., p-methoxyphenyl, m-ethoxyphenyl), a halogen atom (e.g., p-chlorophenyl, p-bromophenyl, p-fluorophenyl), a cyano group (e.g., p-cyanophenyl, o-cyanophenyl), a nitro group (e.g., p-nitrophenyl), an amino group (e.g., p-dimethylaminophenyl), an alkyl group having from 1 to 10 carbon atoms (e.g., p-methylphenyl, o-methylphenyl), an acylamino group (e.g., p-acetylaminophenyl, p-methanesulfonylaminophenyl), a carbamoyl group having from 1 to 10 carbon atoms (e.g., carbamoyl, dimethylaminocarbamoyl), and a sulfamoyl group (e.g., dimethylaminosulfamoyl, piperidinosulfamoyl); or a heterocyclic group (for example, 5- or 6-membered heterocyclic group having nitrogen, oxygen and/or sulfur atom(s), which may optionally be condensed with benzene ring(s), such as 2-pyridyl, 4-pyridyl, 2-pyrimidyl, 2-triazinyl, 2-thiazolyl, 2-benzothiazolyl, 2-imidazolyl, 2-benzimidazolyl).

$L_1$, $L_2$ and $L_3$ are the same or different and each represents a methine group, which may be substituted independently by substituent(s) selected from a methyl group, an ethyl group, a phenyl group, a chlorine atom, a sulfoethyl group and/or a carboxyethyl group.

The carboxyl group or sulfo group of $R_1$, $R_2$, $R_3$ and/or $R_4$ is not restricted to a free acid and may also be a salt (for example, sodium salt, potassium salt, ammonium salt, quaternary ammonium salt).

Although the dyes disclosed in JP-A-1-183652 are used, specific examples of dyes of the formula (I) which are preferably employed in the present invention are mentioned below. However, these are not intended to restrict the scope of the present invention.

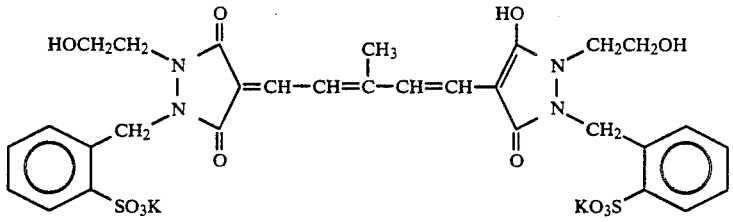

(I-1)

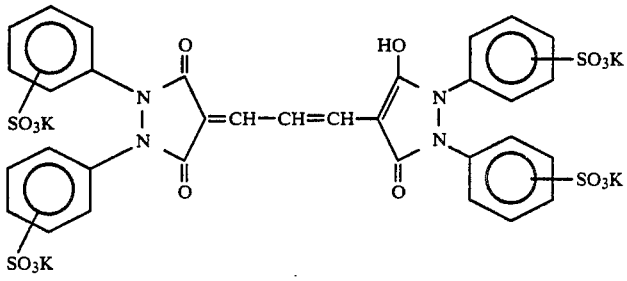

(I-2)

-continued
(I-3)
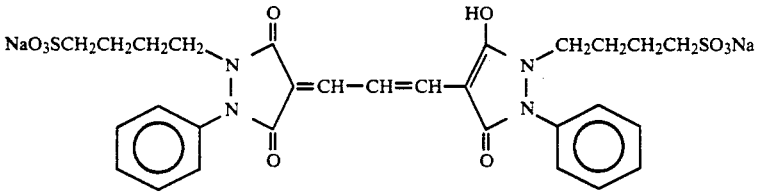
(I-4)
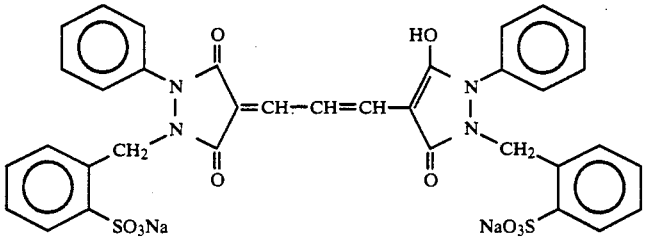
(I-5)
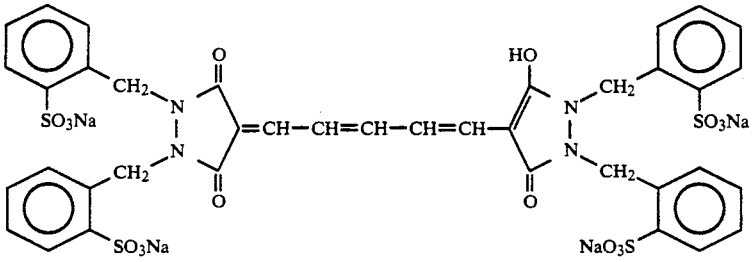
(I-6)
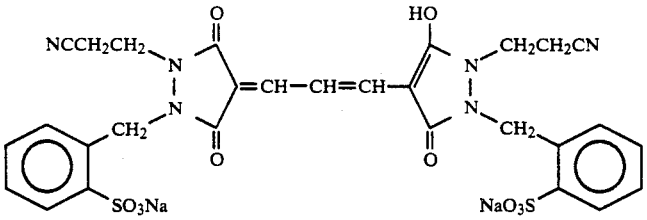
(I-7)
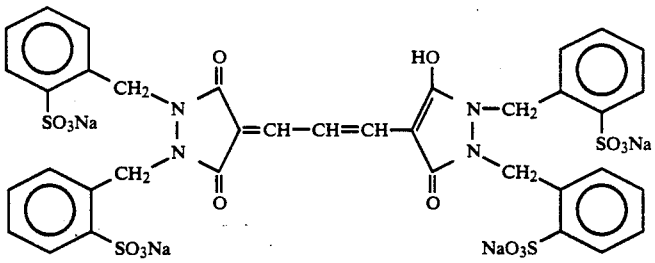
(I-8)
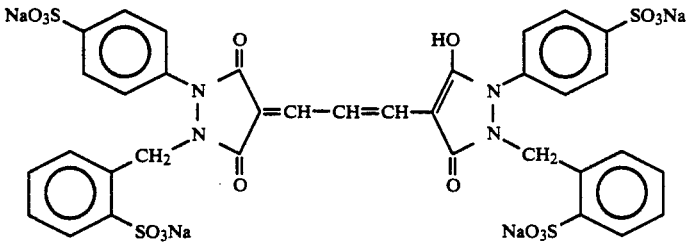

-continued (I-9)

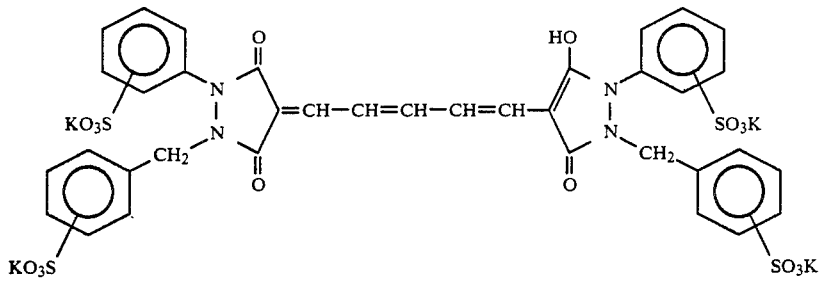

Non-limiting examples of the production of compounds of formula (I) are presented below.

Production Example I-1

Production of Compound (I-2)

16.7 g of 1,2-diphenyl-3,5-pyrazolidinedione was added to 48 ml of concentrated sulfuric acid and 36 ml of 20% fuming sulfuric acid and the mixture was heated in a steam bath for 4 hours. After cooling, the reaction mixture was poured onto ice and then neutralized with a potassium hydroxide solution. The crystal thus precipitated was removed by filtration and washed with methanol to obtain 27 g of a sulfonated product of 1,2-diphenyl-3,5-pyrazolidinedione.

9.7 g of the sulfonated product of 1,2-diphenyl-3,5-pyrazolidinedione, 1.3 g of tetramethoxypropane and 25 ml of methanol were blended, and 2 g triethylamine and 1 ml of acetic acid were added thereto and heated under reflux and 6 hours. The crystal precipitated out was removed by filtration and washed with a hot methanol and thereafter dried to obtain 6.9 g of Compound (I 2).

m.p. 300° C. or higher, $\lambda_{max}^{H2O}$ 493 nm, el. $41\times10^5$.

Production Example I-2

Production of Compound (I-9)

10.7 g of the sulfonated product of 1,2-diphenyl-3,5-pyrazolidinedione obtained in Production Example I-1, 2.8 g of 1-anilino-5-phenylimino-1,3-pentadiene hydrochloride and 4 ml of triethylamine were dissolved in 25 ml of methanol, and 4,5 ml of acetic anhydride was dropwise added thereto with stirring at room temperature. After reacted for further 2 hours, the crystal precipitated was removed by filtration. The resulting crude crystal was added to 50 ml of methanol and washed while hot, and the crystal was removed by filtration and dried to give 7.1 g of Compound (I-11).

m.p. 300° C. or higher, $\lambda_{max}^{H2O}$ 590 nm, el. $80\times10^5$.

Production Example I-3

Production of Compound (I-5)

104 g of phenylhydrazine was dissolved in 800 ml of methanol, and a solution obtained by dissolving 56 g of sodium o-formylbenzenesulfonate in 200 ml of methanol was dropwise added thereto at room temperature. The resulting mixture was heated for 2 hours under reflux with stirring. After cooling, the crystal formed was separated by filtration and then washed with methanol to obtain 69 g of sodium 2-phenylhydrazonobenzenesulfonate (Intermediate A). 50 g of Intermediate A thus obtained was dissolved in 250 ml of water and then hydrogenated in an autoclave by adding palladium-carbon catalyst thereto. After the catalyst was removed by filtration, 250 ml of isopropanol was added to the hydrogenated product whereupon a colorless product precipitated out. This product was separated out by filtration and washed with isopropanol and then dried to obtain 43 g of sodium 2-phenylhydrazinobenzenesulfonate (Intermediate B). Next, 40 g of Intermediate B, 19 g of diethyl malonate, 25 g of sodium methylate (28% methanol solution) and 100 ml of n-butanol were blended and heated for 10 hours under reflux. N-butanol was concentrated and 200 ml of water was added to the residue..Next, the aqueous layer was made acidic with concentrated hydrochloric acid, whereby a crystal precipitated out. This was separated out by filtration and washed with a small amount of methanol to give 39 g of Intermediate C (1-phenyl-2-(2-sulfobenzyl)-3,5-pyrazolidinedione sodium salt).

7.4 g Intermediate C was added to 50 ml of methanol, and 4.2 ml of triethylamine and 2.5 g of malonaldehyde dianil hydrochloride was added thereto and heated to give a uniform solution. After cooled to room temperature, 4.5 ml of acetic anhydride was dropwise added to the solution. After reacted for 2 hours, 25 ml of isopropanol was added to the reaction mixture whereby an orange crystal precipitated out. The crystal was separated out by filtration and washed with isopropanol and then dried to give 5 g of Compound (I-4).

m.p. 300° C. or higher, $\lambda_{max}^{H2O}$ 494 nm, el. $32\times10^5$.

The dyes of the formula (I) can be added to the photographic materials of the present invention in any desired amount that is effective. However, the amount of the dye of formula (I) to be added is preferably controlled so that the optical density of the dye in the coated film at $\lambda_{max}$ is within the range of from 0.05 to 3.0. The time when this dye is added is not specifically limited but may be anytime before the coating composition is coated on the support.

The dye of the formula (I) may be dispersed in the emulsion layers, other hydrophilic colloid layers (interlayer, protective layer, anti-halation layer, filter layer), or colloidal silver layers by various known methods.

For instance, the following methods are preferred.

(1) The dye is directly added to the emulsion layer or hydrophilic colloid layer in the form of a solution or a dispersion of fine solid particles. Alternatively, after the dye has been dissolved in the form of an aqueous solution or dispersed in a solvent in the form of fine solid particles, the resulting solution or dispersion is then added to the emulsion layer or hydrophilic colloid layer. Usable solvents are, for example, methyl alcohol, ethyl alcohol, propyl alcohol, methyl cellosolve, as well as halogenated alcohols described in JP-A-48-9715 and U.S. Pat. No. 3,756,830, and acetone, water and pyridine. The dye may be dissolved in such a solvent or a mixed solvent thereof and the resulting solution maybe added to an emulsion for the emulsion layer.

(2) A hydrophilic polymer having a charge opposite to the dye ion is incorporated into the photographic layer as a mordant agent, and the dye is localized in a particular layer because of the interaction between the mordant and the dye molecule.

As the polymer mordant agent to be used for the purpose, for example, there are mentioned secondary or tertiary amino group-containing polymers, nitrogen-containing heterocyclic moiety-having polymers or the corresponding quaternary cation group-having polymer thereof. Preferred are those having a molecular weight of 5,000 or more, especially preferably 10,000 or more.

Examples of preferred polymers include vinyl-pyridine polymers and vinylpyridinium cation polymers described in U.S. Pat. No. 2,548,564; vinylimidazolium cation polymers described in U.S. Pat. No. 4,124,386; polymer mordant agents capable of crosslinking with gelatin or the like, as described in U.S. Pat. No. 3,625,694; aqueous sol type mordant agents described in U.S. Pat. No. 3,958,995 and JP-A-54-115228; water-insoluble mordant agents described in U.S. Pat. No. 3,898,088; reactive mordant agents capable of bonding with dyes by covalent bond, as described in U.S. Pat. No. 4,168,976; polymers to be derived from dialkylaminoalkylester residue-having ethylenic unsaturated compounds, as described in British Patent 685,475; products to be obtained by reaction of polyvinyl alkylketones and aminoguanidines, as described in British Patent 850,281; and polymers to be derived from 2-methyl-1-vinylimidazoles, as described in U.S. Pat. No. 3,445,231.

(3) The dye of the formula (I) is dissolved with a surfactant and the resulting solution is added to the emulsion layer, hydrophilic colloid layer, or colloidal silver layer.

Surfactants to be used for the purpose may be in the form of an oligomer or polymer.

The details of the polymers are described in JP-A-60-158437, pages 19 to 27.

If desired, a hydrosol of an oleophilic polymer, for example, those described in JP-B-51-39835, can be added to the hydrophilic colloid as formed in the above-mentioned processes.

As the hydrophilic colloid for use in the present invention, gelatin is typical, but any others which are known usable for photographic use can be used in the present invention.

The bleaching accelerators of formulae (II) to (VIII) are explained in detail below.

The positive-positive silver halide photographic materials of the present invention are preferably processed using a compound represented by any one of the following formulae (II) to (VIII). The selected compound is added to a processing bath having a bleaching capacity or to the pre-bath of such a processing bath.

The bleaching accelerators of formulae (II) to (VIII) are explained in detail below.

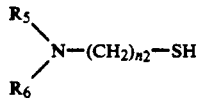

(II)

In the formula, $R_5$ and $R_6$ may be the same or different and each represents a hydrogen atom, or a lower alkyl group (preferably having from 1 to 5 carbon atoms, preferably, methyl, ethyl, propyl), or an acyl group (preferably having from 1 to 3 carbon atoms, for example, acetyl, propionyl); and $n_2$ represents 1, 2, or 3. The alkyl or acyl group may be substituted.

$R_5$ and $R_6$ may be bonded to each other to form a ring.

$R_5$ and $R_6$ each is especially preferably a lower alkyl group, which may be substituted.

As substituents for groups $R_5$ and $R_6$, there are mentioned, for example, a hydroxyl group, a carboxyl group, a sulfo group, and an amino group.

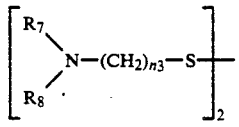

(III)

In the formula, $R_7$ and $R_8$ have the same meanings as $R_5$ and $R_6$ in the formula (II); and $n_3$ represents 1, 2, or 3.

$R_7$ and $R_8$ may be bonded to each other to form a ring.

$R_7$ and $R_8$ is especially preferably a lower alkyl group, which may be substituted.

As substituents for groups $R_7$ and $R_8$, there are mentioned, for example, a hydroxyl group, a carboxyl group, a sulfo group, and an amino group.

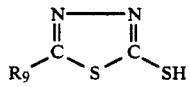

(IV)

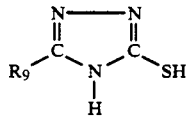

(V)

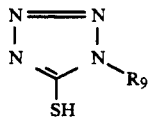

(VI)

In these formulae, $R_9$ represents a hydrogen atom, a halogen atom (e.g., chlorine, bromine), an amino group, a lower alkyl group (preferably having from 1 to 5 carbon atoms, such as methyl, ethyl, propyl), or an alkyl (having 1 to 5 carbon atoms)-substituted amino group (e.g., methylamino, ethylamino, diethylamino). The alkyl group may be substituted.

As substituents for group $R_9$, there are mentioned, for example, a hydroxyl group, a carboxyl group, a sulfo group, and an amino group.

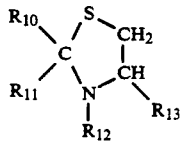

(VII)

In the formula, $R_{10}$ and $R_{11}$ may be the same or different and each represents a hydrogen atom, an alkyl group (preferably, a lower alkyl group having 1 to 6 carbon atoms such as methyl, ethyl, propyl group), a phenyl group, or a heterocyclic group (e.g., a heterocyclic group having at least one or more hetero atoms of nitrogen, oxygen and/or sulfur atom(s), such as pyridine ring, thiophene ring, thiazolidine ring, benzoxazole ring, benzotriazole ring, thiazole ring, imidazole ring). These groups may be substituted.

$R_{12}$ represents a hydrogen atom or a lower alkyl group (preferably having from 1 to 3 carbon atoms, such as methyl, ethyl). The alkyl group may be substituted.

As substituents for groups $R_{10}$ to $R_{12}$, there are mentioned, for example, a hydroxyl group, a carboxyl group, a sulfo group, an amino group, a lower alkyl group having 1 to 6 carbon atoms.

$R_{13}$ represents a hydrogen atom or a carboxyl group.

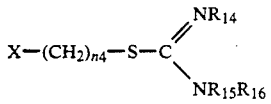

(VIII)

In the formula $R_{14}$, $R_{15}$ and $R_{16}$ may be the same or different and each represents a hydrogen atom or a lower alkyl group (preferably having from 1 to 3 carbon atoms, such as methyl, ethyl).

$R_{14}$ and $R_{15}$ or $R_{16}$ may be bonded to each other to form a ring.

X represents an amino group optionally having substituent(s) (for example, a lower alkyl group having 1 to 6 carbon atoms such as methyl group, and an alkoxyalkyl group having 2 to 6 carbon atoms such as acetoxymethyl), or a sulfonic acid group or a carboxyl $R_{14}$ to $R_{16}$ each is especially preferably a hydrogen atom, or a methyl group or ethyl group; and X is especially preferably an amino group or a dialkylamino group.

Specific examples of compounds of formulae (II) to (VIII) are mentioned below, which, however, are not limitative.

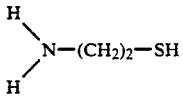

(II)-(1)

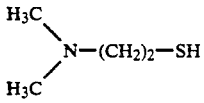

(II)-(2)

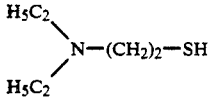

(II)-(3)

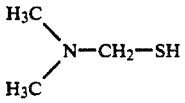

(II)-(4)

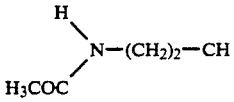

(II)-(5)

-continued

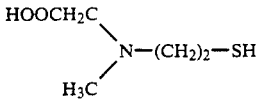

(II)-(6)

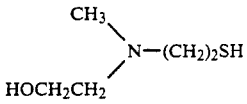

(II)-(7)

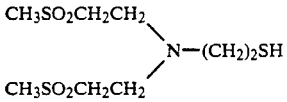

(II)-(8)

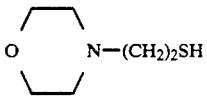

(II)-(9)

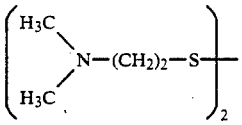

(III)-(1)

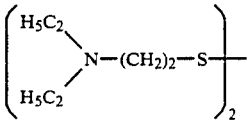

(III)-(2)

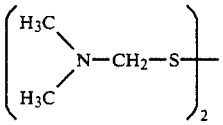

(III)-(3)

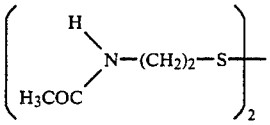

(III)-(4)

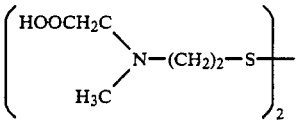

(III)-(5)

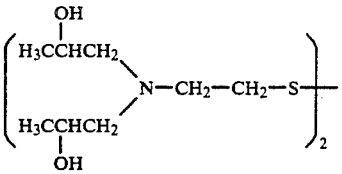

(III)-(6)

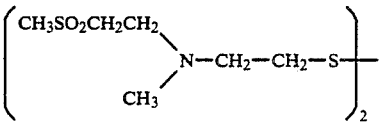

(III)-(7)

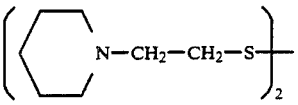

(III)-(8)

-continued
(III)-(9)
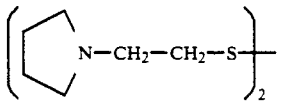
(III)-(10)
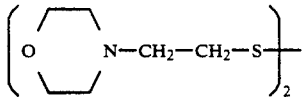
(IV)-(1)
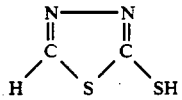
(IV)-(2)
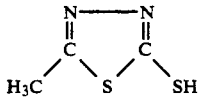
(IV)-(3)
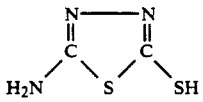
(IV)-(4)
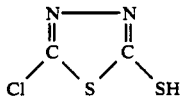
(V)-(1)
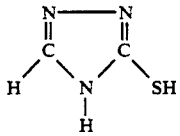
(V)-(2)
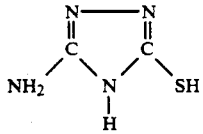
(V)-(3)
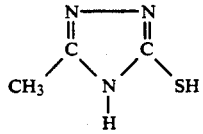
(VI)-(1)
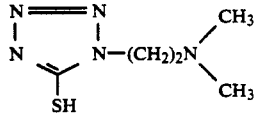
(VI)-(2)
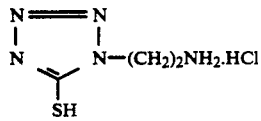
(VII)-(1)
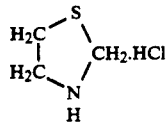
-continued
(VII)-(2)
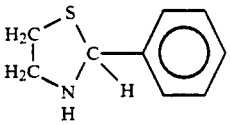
(VII)-(3)
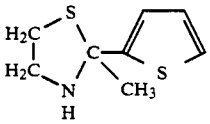
(VII)-(4)
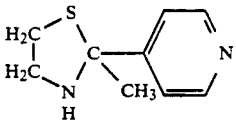
(VII)-(5)
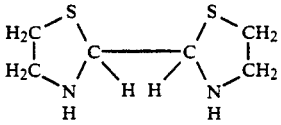
(VII)-(6)
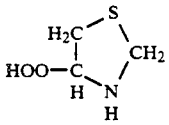
(VIII)-(1)
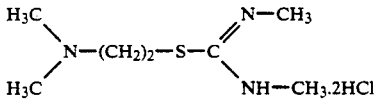
(VIII)-(2)
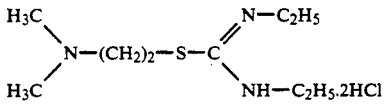
(VIII)-(3)
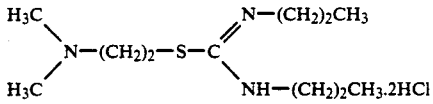
(VIII)-(4)
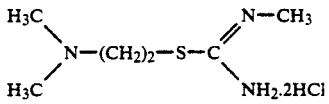
(VIII)-(5)
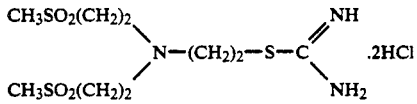
(VIII)-(6)
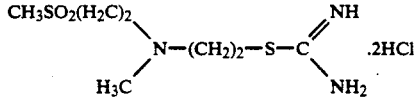
(VIII)-(7)
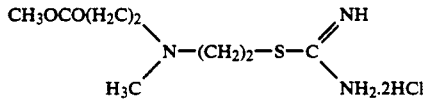
(VIII)-(8)
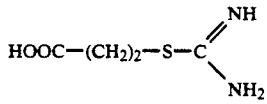

-continued

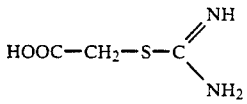

(VIII)-(9)

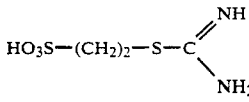

(VIII)-(10)

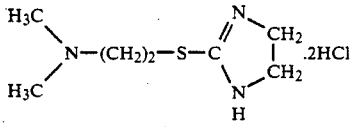

(VIII)-(11)

All the above-mentioned compounds can be produced by known methods. For example, the production of compounds of the formula (II) are described in U.S. Pat. No. 4,285,984, G. Schwarzenbach et al., *Helv. Chim. Acta.*, 38, 1147 (1955), and R.O. Clinton et al., *J. Am. Chem. Soc.*, 70, 950 (1948); those of the formula (III) are described in JP-A-53-95630; those of the formulae (IV) and (V) are described in JP-A-54-52534; those of the formula (VI) are described in JP-A-51-68568, JP-A-1-70763 and JP-A-53-50169; those of the formula (VII) are described in JP-B-53-9854 and JP-A-59-214855; and those of the formula (VIII) are described in JP-A-53-94927.

When compounds having a mercapto group or disulfido bond in the molecule, or thiazoline derivatives or isothiourea derivatives to be employed in the present invention are incorporated into a bleaching solution, the amount thereof in the solution varies in accordance with the kinds of the photographic materials to be processed, the processing temperature and the time necessary for the intended processing. Generally, the amount is from $1\times10^{-5}$ to $10^{-1}$ mol, preferably from $1\times10^{-4}$ to $5\times10^{-2}$ mol, per liter of the processing solution.

Generally, for adding the compounds of the present invention to the processing solution, the compound is previously dissolved in water, an alkali, an organic acid or, an organic solvent, and the resulting solution is added to the processing solution. However, the compounds may be added directly to the bleaching bath in the form of a powder without negatively affecting the bleaching acceleration.

The colloidal silvers which are employed in the present invention are explained in detail below.

As a colloidal silver containing layer, there is mentioned a widely used yellow filter layer containing a yellow colloid layer. But it includes other layers, e.g., an intermediate layer containing gray colloidal silver, a colloidal silver layer for improving graininess.

Any of yellow, brown, blue, and black colloidal silvers can be employed in preparing the photographic material of the present invention. It is also possible that the material of the invention have at least two layers each having a colloidal silver of a different color. The layer to which the color colloidal silver is incorporated is not specifically defined but any two or more layers may be selected from emulsion layers and non-emulsion layers (non-light-sensitive layers) for the purpose of incorporating the color colloidal silver thereinto. Preferably, the color colloidal silver is added to layers adjacent to the emulsion layers. It is also preferred to add a yellow colloidal silver to a layer below a blue-sensitive layer, whereby the yellow colloidal silver-containing layer may also function as a filter layer. The amount of the colloidal silver to be added for this purpose is preferably from 0.0001 to 0.4 g/m$^2$, more preferably from 0.0003 to 0.3 g/m$^2$.

Preparation of colloidal silver of various kinds is described, for example, in Weiser, *Colloidal Elements* (preparation of yellow colloidal silver by Carey Lea's dextrin reduction method) (published by Will & Sons, New York, 1933), or West German Patent 1,096,193 (preparation of brown and black colloidal silvers), or in U.S. Pat. No. 2,688,601 (preparation of blue colloidal silver).

The size of the colloidal silver for use in the present invention is not specifically defined but may vary within the range of from 14Å to 0.1 micron as a mean grain size in accordance with the object and use of the invention.

Next, the sensitizing dyes of formula (IX) which are employed in the present invention are explained in detail below.

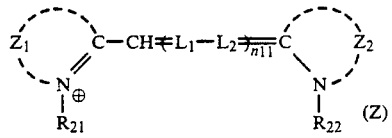

(IX)

(Z)

In the formula, $Z_1$ and $Z_2$ are the same or different and each represents an atomic group necessary for forming a benzothiazole nucleus, a naphthothiazole nucleus, a benzoselenazole nucleus or a naphthoselenazole nucleus.

$R_{21}$ and $R_{22}$ are the same or different and each represents an alkyl group having 1 to 6 carbon atoms, provided that at least one of $R_{21}$ and $R_{22}$ has a sulfo group or a carboxyl group. The alkyl group may be substituted.

$L_1$ and $L_2$ are the same or different and each represents a methine group. The methine group may be substituted.

$n_{11}$ represents 0, 1, or 2.

Z represents a group for satisfying the charge balance of the compound of the formula (IX), and when the compound has no Z, it forms an internal salt.

The substituent for $R_{21}$, $R_{22}$, $L_1$, and $L_2$ includes e.g., a hydroxyl group, an alkoxy group having 1 to 6 carbon atoms, a carboxyl group, a sulfo group, a cyano group.

The compound of the formula (IX) is incorporated into the silver halide photographic emulsion in an amount of from $1\times10^{-6}$ to $5\times10^{-3}$ mol, preferably from $3\times10^{-6}$ to $2.5\times10^{-3}$ mol, especially preferably from 8x10-6 to $1\times10^{-3}$ mol, per mol or the silver halide in the emulsion. The compound of the formula (IX) may be combined with any other useful sensitizing dye(s). Among the compounds of the formula (IX), those of the following formulae (X) and (XI) are preferred.

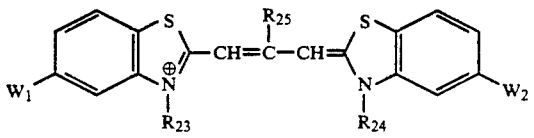

(X)

(Z)

where $W_1$ and $W_2$ are the same or different and each represents a hydrogen atom, a halogen atom, a substituted or unsubstituted alkyl group, a substituted or unsubstituted alkoxy group, a substituted or unsubstituted aryl group, a substituted or unsubstituted aryloxy group, a hydroxyl group, a carboxyl group, a substituted or unsubstituted alkoxycarbonyl group, an acyloxy group, an acylamino group, an acyl group, a substituted or unsubstituted carbamoyl group, or a heterocyclic group; $R_{23}$ and $R_{24}$ are the same or different and each represent a substituted or unsubstituted alkyl group, provided that at least one of them represents a hydroxyalkyl group, a carboxyalkyl group or a sulfoalkyl group;

$R_{25}$ represents a hydrogen atom, a substituted or unsubstituted alkyl group, or substituted or unsubstituted aryl group;

Z represents a group for satisfying the charge balance of the compound of the formula (X), and when the compound has no Z, it forms an internal salt.

(XI)

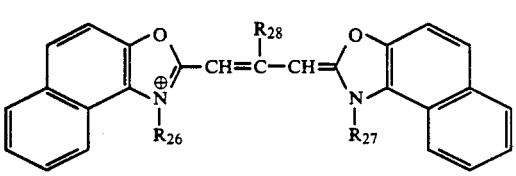

(Z)

where $R_{26}$ and $R_{27}$ are the same or different and each represents a substituted or unsubstituted alkyl group, provided that at least one of them represents a hydroxyalkyl group, a carboxyalkyl group or a sulfoalkyl group; $R_{28}$ represents a hydrogen atom, a substituted or unsubstituted alkyl group, a substituted or unsubstituted aryl group, or a negatively charged ketomethylene residue for forming a holopolar cyanine dye;

Z represents a group for satisfying the charge balance of the compound of the formula (XI), and when the compound has no Z, it forms an internal salt.

Next, compounds of the formula (X) will be explained in detail below.

In the formula (X), $W_1$ and $W_2$ are the same or different and each represents a hydrogen atom; a halogen atom (e.g., fluorine, chlorine, bromine, iodine); an alkyl group having from 1 to 12 carbon atoms, preferably from 1 to 5 carbon atoms; a substituted alkyl group having from 1 to 18 carbon atoms, preferably from 1 to 8 carbon atoms; an alkoxy group having from 1 to 12 carbon atoms, preferably from 1 to 5 carbon atoms; a substituted alkoxy group having from 1 to 18 carbon atoms, preferably from 1 to 8 carbon atoms; a substituted or unsubstituted aryl group having from 6 to 10 carbon atoms, preferably from 6 to 8 carbon atoms; a substituted or unsubstituted aryloxy group having from 6 to 10 carbon atoms, preferably from 6 to 8 carbon atoms; a hydroxyl group; a carboxyl group; a substituted or unsubstituted alkoxycarbonyl group having from 2 to 18 carbon atoms, preferably from 2 to 8 carbon atoms, an acyloxy group having from 2 to 12 carbon atoms, preferably from 2 to 7 carbon atoms; an acylamino group having from 2 to 12 carbon atoms, preferably from 2 to 7 carbon atoms; an acyl group having from 2 to 12 carbon atoms, preferably from 2 to 7 carbon atoms; a substituted or unsubstituted carbamoyl group having from 1 to 12 carbon atoms, preferably from 1 to 8 carbon atoms; or a heterocyclic group (e.g., 2-thienyl, 2-thiazolyl, 2-furyl).

$R_{23}$ and $R_{24}$ are the same or different and each represents an alkyl group having from 1 to 20 carbon atoms, preferably from 1 to 5 carbon atoms; or a substituted alkyl group having from 1 to 20 carbon atoms, preferably from 1 to 8 carbon atoms.

$R_{25}$ represents a hydrogen atom, a substituted or unsubstituted alkyl group having from 1 to 8 carbon atoms, or a substituted or unsubstituted aryl group having from 6 to 10 carbon atoms; and it is preferably a hydrogen atom, a methyl group, an ethyl group, or a phenyl group; and it is especially preferably an ethyl group.

The substituent for $W_1$ and $W_2$ includes, e.g., a hydroxyl group, an alkoxy group having 1 to 6 carbon atoms, an amino group, a cyano group. The substituent for $R_{23}$ and $R_{24}$ includes, e.g., a hydroxyl group, an alkoxy group having 1 to 6 carbon atoms, an amino group, a cyano group, a carboxyl group, a sulfo group. The substituent for $R_{25}$ includes a hydroxyl group, an alkoxy group, an amino group, a cyano group.

Z represents a group for satisfying the charge balance of the compound of the formula. Where it is an anion, it may be a halide ion such as chloride, bromide or iodide ion; an alkylsulfato ion such as methylsulfato or ethylsulfato ion; an arylsulfonato ion such as p-toluenesulfonato or p-chlorophenylsulfonato ion; or a perchlorato ion. Where it is a cation, it may be pyridinium ion, triethylammonium ion, sodium ion, potassium ion or hydrogen ion.

Where the formula (X) has no Z, the compound forms an internal salt.

Next, compounds of the formula (XI) will be explained in detail hereunder.

In the formula (XI), $R_{26}$ and $R_{27}$ are the same or different and each represents an alkyl group having from 1 to 20 carbon atoms, preferably from 1 to 5 carbon atoms, or a substituted alkyl group having from 1 to 20 carbon atoms, preferably from 1 to 8 carbon atoms (for example, a sulfoalkyl group such as 2-sulfoethyl, 3-sulfopropyl, 4-sulfobutyl or 3-sulfobutyl group; a sulfoaralkyl group such as 2-(4-sulfophenyl)ethyl group; a carboxyalkyl group such as carboxymethyl, 2-carboxyethyl or 3-carboxypropyl group; a hydroxyalkyl group such as 2-hydroxyethyl or 3-hyroxypropyl group; and alkoxyalkyl group such as 2-methoxyethyl, 2-ethoxyethyl or 2-(2-methoxyethoxy)ethyl group; a halogenated alkyl group such as 2,2,2 trifluoroethyl or 2,2,3,3-tetrafluoropropyl group; an alkanesulfonylaminoalkyl group such as 2-methanesulfonylaminoethyl group; or an alkenylalkyl group such as allyl group).

$R_{28}$ represents a hydrogen atom; a substituted or unsubstituted alkyl group having from 1 to 8 carbon atoms; a substituted or unsubstituted aryl group having from 6 to 10 carbon atoms; or a group of formula (A):

(A)

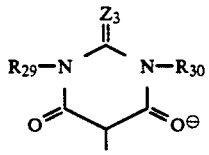

in which $Z_3$ represents an oxygen atom or a sulfur atom, and $R_{29}$ and $R_{30}$ are the same or different and each represents an alkyl group having 6 or less carbon atoms, a substituted alkyl group having 6 or less carbon atoms (where the substituent(s) may be selected from a chlorine atom, a fluorine atom and a phenyl group) or an alkoxy group having from 1 to 4 carbon atoms.

Preferably, $R_{28}$ represents a hydrogen atom, a methyl group, an ethyl group or a phenyl group; and it is especially preferably an ethyl group.

Z represents a group for satisfying the charge balance of the compound. Where it is an anion, it may be, for example, a halide ion such as chloride, bromide or iodide ion; an alkylsulfato ion such as methylsulfato or ethylsulfato ion; an arylsulfonato ion such as p-toluenesulfonato or p-chlorophenylsulfonato ion; or a perchlorato ion. Where it is a cation, it may be, for example, pyridinium ion, triethylammonium ion, sodium ion, potassium ion or hydrogen ion.

Where the formula (XI) has no Z, the compound forms an internal salt.

Specific non-limiting examples of compounds of the formula (IX) are mentioned below.

IX-1

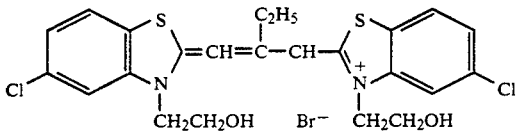

IX-2

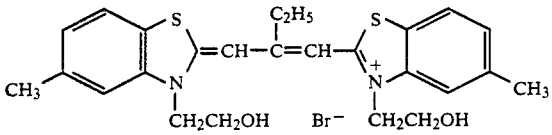

IX-3

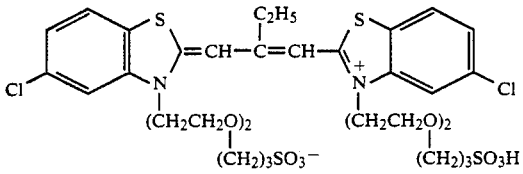

IX-4

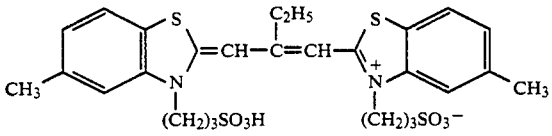

IX-5

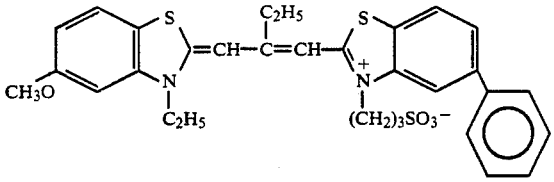

IX-6

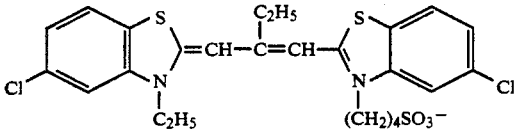

IX-7

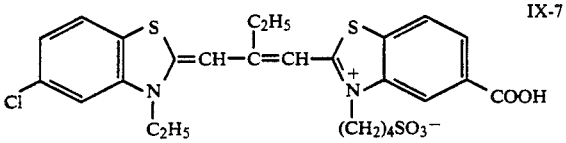

-continued

IX-8

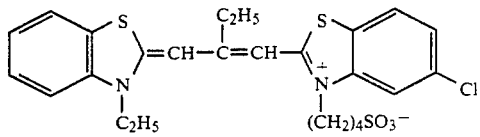

IX-9

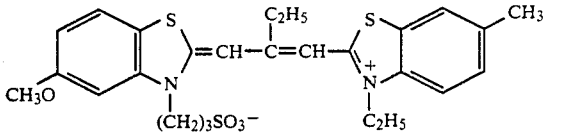

IX-10

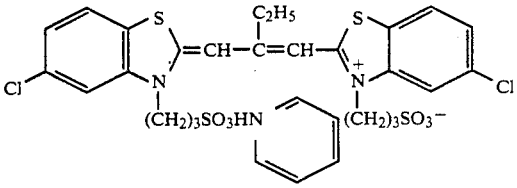

IX-11

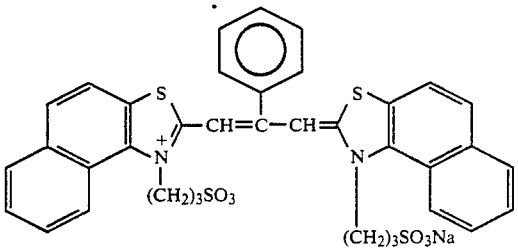

IX-12

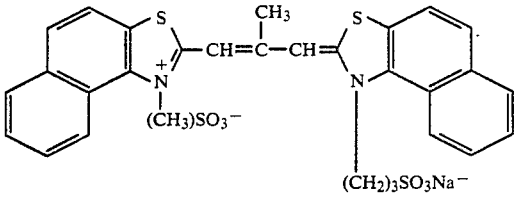

IX-13

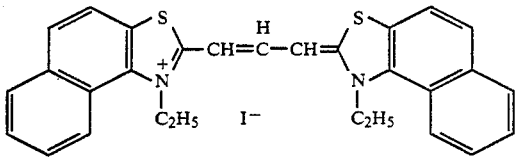

IX-14

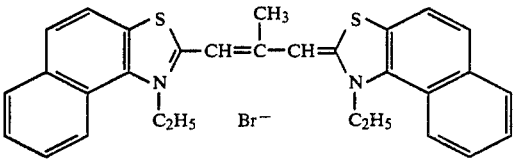

IX-15

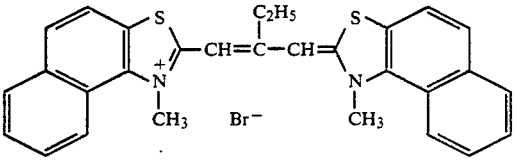

-continued

IX-16

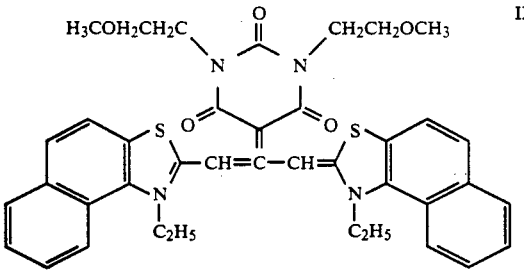

IX-17

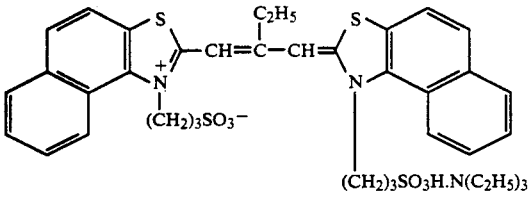

IX-18

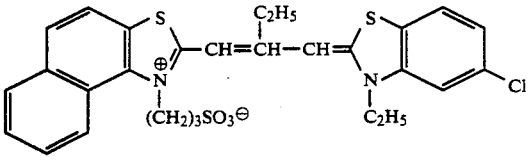

IX-19

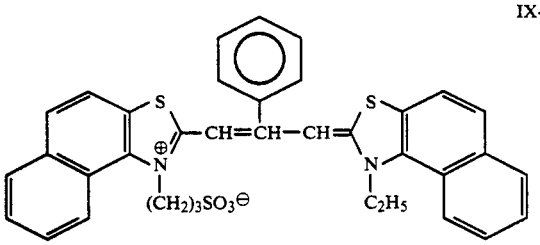

IX-20

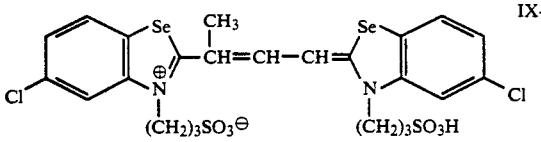

IX-21

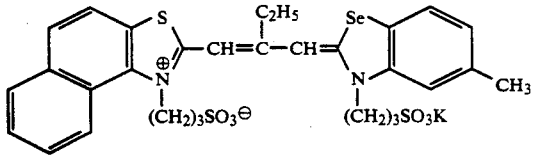

The sensitizing dyes of formula (IX), (X), and (XI) can be easily synthesized by the method as disclosed, for example, in F. M. Hamer, *Heterocyclic compounds-Cyanine dyes and related compounds*, chapter IV, V, VI, pages 86 to 199, John Wiley & Son, New York, London, 1964, D. M. Sturmer, *Heterocyclic Compounds-Special topics in Heterocyclic Chemistry*, chapter VIII, sec. IV, pages 482 to 515, John Wiley & Son, New York, London, 1977.

Compounds of the formula (IX) may be combined with other cyanine dyes, merocyanine dyes or complex merocyanine dyes, such as those described in *Research Disclosure* Item No. 17643-IV (December 1973), for use in the present invention.

Where sensitizing dyes of the above-mentioned formulae (X) and/or (XI) are combined with a compound of the formula (IX) for use in the present invention, the molar ratio of the former to the latter is preferably within the range of from 0 to 2.

The sensitizing dyes to be employed in the present invention can be dispersed directly in the emulsion. Alternatively, the dye may first be dissolved in a solvent, such as methyl alcohol, ethyl alcohol, methyl cellosolve, acetone, water or pyridine or a mixed solvent thereof, and the resulting solution may be added to the emulsion. For dissolution of the dyes, ultrasonic waves may be employed. For addinq the sensitizing dyes to the emulsion, various methods may be employed. Such methods include, for example, a method of dissolving a dye in a volatile organic solvent, dispersing the resulting solution into a hydrophilic colloid, and adding the resulting dispersion into an emulsion, as described in U.S. Pat. No. 3,469,987; a method of dispersing a water-insoluble dye directly in a water soluble solvent without dissolving the dye and adding the resulting dispersion to an emulsion, as described in JP-B-46-24185; a method of dissolving a dye in a surfactant-containing solution and adding the resulting solution to an emulsion, as described in U.S. Pat. No. 3,822,135; a method of dissolving a dye in a red-shifting compound and adding the resulting solution to an emulsion, as described in JP-A-51-74624; and a method of dissolving a dye into a substantially water-free acid and adding the resulting solution to an emulsion, as described in JP-A-50-80826. Additionally, other methods described in U.S. Pat. Nos. 2,912,343, 3,342,605, 2,996,287 and 3,429,835 may also be employed for adding the dye-containing solution to the emulsion of the invention. The above-mentioned sensitizing dyes may be uniformly dispersed in the silver halide emulsion before coating the emulsion on a pertinent support. As a matter of course, the dye may be added to the silver halide emulsion at any stage of preparing the emulsion.

In the present invention, a spectral sensitivity is a photographic sensitivity which is determined with respect to a specific wavelength. Generally, a red-sensitive layer shows large sensitivity to light having a wavelength between 600 nm and 700 nm. In this case, when a red-sensitive layer has the sensitivity in a particularly shorter wavelength side, separation with green sensitivity becomes poor and it is not suitable in view of color reproduction. In particular, in a positive-positive silver halide color photographic material, which is required broader sensitivity distribution due to diversity of the originals, broad distribution and good separation have been contradicted each other. As a result of intensive study, this problem is overcome when the following relationship is satisfied:

$$(\lambda_{smax-0.1})-(\lambda_{smax-0.6})<30 \text{ nm}$$

wherein $\lambda_{smax}$ represents a wavelength at the Spectral maximum sensitivity, Smax, in a red sensitive emulsion layer, $\lambda_{smax-0.1}$ represents a short wavelength side in which the sensitivity is lower than that of $\lambda_{smax}$ by 0.1, and $\lambda_{smax-0.6}$ represents a wavelength in a short wavelength side in which the sensitivity is lower than that of $\lambda_{smax}$ by 0.6. The relationship is preferably lower than 20 nm.

The photographic emulsion layers of the photographic material of the present invention may contain any silver halide such as silver bromide, silver iodobromide, silver iodochlorobromide, silver chlorobromide and silver chloride.

The silver halide grains in the photographic emulsions may be so-called regular grains having a regular crystalline form such as cubic, octahedral or tetradecahedral crystalline form, or irregular grains having an irregular crystalline form such as spherical crystalline form or having a crystal defect such as twin plane, or composite grains comprising the both crystalline forms. Additionally, a mixture comprising grains having different crystalline forms may also be employed in the present invention.

Regarding the grain size of the silver halide grains, they may be either fine grains having a small grain size of approximately 0.1 micron or less or large grains having a large grain size of approximately 10 microns or more as a diameter of the projected area of the grain. The emulsion may be either a monodispersed emulsion having a narrow grain size distribution or a polydispersed emulsion having a broad grain size distribution.

The silver halide photographic emulsions for use in the present invention can be produced by known methods. For example, they can be produced by methods described in *Research Disclosure,* Vol. 176, Item No. 17643 (December 1978), pages 22 to 23, "I. Emulsion Preparation and Types" and in ibid., Vol. 187, Item No. 18716 (November 1979), page 648.

The photographic emulsions for use in the present invention may also be prepared by methods described in P. Glafkides, *Chimie et Physique Photographique* (published by Paul Montel, 1967), Duffin, *Photographic Emulsion Chemistry* (published by Focal Press, 1966), or V. L. Zelikman et al., *Making and Coating Photographic Emulsion* (published by Focal Press, 1964). Precisely, they may be prepared by any of an acid method, a neutral method or an ammonia method. As a method of reacting a soluble silver salt and soluble halide(s), a single jet method, a double jet method or a combination thereof may be employed. A so-called reverse jet method of forming silver halide grains in the presence of excess silver ions may also be employed. As one example of a double jet method, a so-called controlled double jet method where the pAg value in the liquid phase of forming silver halide grains is kept constant is usable. According to the method, a silver halide emulsion containing grains having a regular crystalline form and having almost uniform grain sizes can be obtained.

The emulsions may be physically ripened, if desired, in the presence of a known silver halide solvent (for example, ammonia, potassium thiocyanate, or thioethers or thione compounds described in U.S. Pat. No. 3,271,157, JP-A-51-12360, JP-A-53-82408, JP-A-53-144319, JP-A-54-100716 or JP-A-54-155828). Also in accordance with the method, a silver halide emulsion containing grains having a regular crystalline form and having almost uniform grain sizes can be obtained.

The above-mentioned regular grains-containing silver halide emulsion may be obtained by controlling the pAg and pH values during formation of the grains.

The details are described, for example, in *Photographic Science and Engineering,* Vol. 6, pages 159 to 165 (1962); *Journal of Photographic Science,* Vol. 12, pages 242 to 251 (1964); and U.S. Pat. No. 3,655,394 and British Pat. No. 1,413,748.

As one typical example of monodispersed emulsions for use in the present invention, there is mentioned an emulsion containing silver halide grains having a mean grain size of more than about 0.05 micron, in which at least 95% by weight of the grains have a grain size falling within the range of the mean grain size plus/minus 40%. Additionally, an emulsion containing silver halide grains having a mean grain size of from 0.15 to 2 microns, in which at least 95% by weight or by number of the grains have a grain size falling within the range of mean grain size plus/minus 20%, may also be used in the present invention. Methods of preparing such emulsions are described in U.S. Pat. Nos. 3,574,628 and 3,655,394 and British Patent 1,413,748. In addition, monodispersed emulsions as described in JP-A-48-8600, JP-A-51-39027, JP-A-51-83097, JP-A-53-137133, JP-A-54-48521, JP-A-54-99419, JP-A-58-37635 and JP-A-58-49938 are also preferably employed in the present invention.

Moreover, tabular silver halide grains having an aspect ratio of 5 or more may also be employed in the present invention. Such tabular grains may easily be prepared by methods described in Gutoff, Photographic Science and Engineering, Vol. 14, pates 248 to 257 (1970); and in U.S. Pat. Nos. 4,434,226, 4,414,310, 4,433,048 and 4,439,520 and British Patent 2,112,157. Use of such tabular grains in the present invention is advantageous, since the coating power is elevated and the color-sensitizing efficiency by sensitizing dyes used is improved. The matter is described in detail in the above-mentioned U.S. Pat. No. 4,434,226.

In the step of forming the silver halide grains for use in the present invention, sensitizing dyes or additives of certain kinds may be employed so as to form silver halide grains having controlled crystalline forms.

The crystalline structure in the grains for use in the present invention may be either uniform or composed of different halogen compositions in the inside (core) and the outside (shell) thereof. In the latter case, the grain may have a layered structure. Emulsion grins of such types are mentioned in detail, for example, in British Patent 1,027,146, U.S. Pat. Nos. 3,505,068 and 4,444,877 and JP-A-60-143331. Additionally, silver halide grains where different silver halides have been bonded by epitaxial bond, as well as silver halide grains having any other compounds than silver halides, such as silver rhodanide or lead oxide, as bonded to silver halide(s) may also be employed in the present invention. Emulsion grains of such types are illustrated in, for example, U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

Additionally, so-called internal latent image type grains, which have been prepared by chemically ripening the surfaces of silver halide grains to form light-sensitive nuclei (e.g., $Ag_2S$, AgN, Au) followed by growing silver halides around the nuclei, may also be employed in the present invention.

In the step of forming the silver halide grains for use in the present invention or of physically ripening them, a cadmium salt, a zinc salt, a lead salt, a thallium salt, an iridium salt or a complex salt thereof, a rhodium salt or a complex salt thereof, an iron salt or a complex salt thereof can be added to the reaction system.

The above-mentioned various emulsions for use in the present invention may be surface latent image type ones which form a latent image essentially on the surfaces of the grains or internal latent image type ones which form a latent image essentially in the insides of the grains.

Further, a direct reverse emulsion may also be used in the present invention. It may be anyone of a solarization type emulsion, an internal latent image type one, a light-fogging type one and a nucleating agent-containing type one, or it may be a mixture of them.

Among the above-mentioned various direct reverse emulsions, an unfogged internal latent type emulsion may be used to be fogged before or during processing by exposure to light or by the use of a nucleating agent whereby a positive image may directly be obtained.

The unfogged internal latent image type silver halide emulsion to be used in the present invention is one containing silver halide grains whose surfaces are not previously fogged and which form a latent image essentially in the insides of the grains. More precisely, one means of selecting the unfogged internal latent image type silver halide emulsion for use in the present invention is as follows. The silver halide emulsion to be tested is coated on a transparent support in a determined amount, this is exposed for a determined period of from 0.01 second to 10 seconds and then developed with the following developer (A) (internal developer) at 20° C. for 6 minutes, and the maximum density of the image formed is determined by conventional photographic densitometery. On the other hand, the same silver halide emulsion is coated on the same support in the same manner as above and then exposed also in the same manner as above. The thus exposed material is then developed with the follow in developer (B) (surface developer) at 18° C. for 5 minutes and the maximum density of the image formed is determined also in the same manner as above. When the value of the maximum density obtained in the former (developed with the internal developer (A)) is at least 5 times or more, preferably at least 10 times or more, or that obtained in the latter (developed with the surface developer (B)), the emulsion tested is preferably employed as the unfogged internal latent image emulsion in the present invention.

| | |
|---|---|
| Internal Developer (A): | |
| Metol | 2 g |
| Sodium Sulfite (Anhydride) | 90 g |
| Hydroquinone | 8 g |
| Sodium Carbonate (Monohydrate) | 52.5 g |
| KBr | 5 g |
| KI | 0.5 g |
| Water to make | 1 liter |
| Surface Developer (B): | |
| Metol | 2.5 g |
| L-ascorbic Acid | 10 g |
| $NaBO_2.4H_2O$ | 35 g |
| KBr | 1 g |
| Water to make | 1 liter |

As examples of internal latent image type emulsions of the type mentioned above, there are convention type silver halide emulsions described in, for example, British Patent 1,011,062 and U.S. Pat. Nos. 2,592,250 and 2,456,943, as well as core/shell type silver halide emulsions. Examples of core/shell type silver halide emulsions of the kind are described in, for example, JP-A-47-32813, JP-A-47-32814, JP-A-52-134721, JP-A-52-156614, JP-A-53-60222, JP-A-53-66218, JP-A-53-66727, JP-A-55-127549, JP-A-57-136641, JP A-58-70221, JP-A-59-208540, JP-A-59-216136, JP-A 60-107641, JP-A-60 247237, JP-A-61-2148 and JP-A-61-3137; JP-B-56-18939, JP-B-58-1412, JP-B-58-1415, JP-B-58-6935 and JP-B-58-108528; JP-A-62-194248; U.S. Pat. Nos. 3,206,313, 3,317,322, 3,761,266, 3,761,276, 3,850,067, 3,923,513, 4,035,185, 4,395,478 and 4,504,570; European Patent 0017148; and Research Disclosure Item No. 16345 (November 1977).

For removing soluble silver salts from the emulsion before or after physical ripening thereof, noddle washing, flocculation sedimentation or ultra-filtration may be employed.

The emulsions for use in the present invention are generally those as physically ripened, chemically ripened or color-sensitized. Additives usable in such processes or ripening or sensitization are described in the above-mentioned *Research Disclosure* Item No. 17643 (December 1978) and No. 18716 (November 1979), and the related descriptions given therein are mentioned below.

Known photographic additives which are usable in the present invention are also described in the said two literatures, and the related descriptions given therein are also mentioned below.

| Kind of Additives | RD 17643 | RD 18716 |
|---|---|---|
| 1. Chemical Sensitizer | p. 23 | p. 648, right column |
| 2. Sensitivity-enhancer | | p. 648, right column |
| 3. Spectral Sensitizer Super Color Sensitizer | pp. 23 to 24 | from p. 648, right column to p. 649, right column |
| 4. Brightening Agent | p. 24 | |
| 5. Anti-foggant Stabilizer | pp. 24 to 25 | p. 649, right column |
| 6. Light Absorbent Filter Dye UV Absorbent | pp. 25 to 26 | from p. 649, right column to p. 650, left column |
| 7. Stain Inhibitor | p. 25, right column | p. 650, from left to right column |
| 8. Color Image Stabilizer | p. 25 | |
| 9. Hardening Agent | p. 26 | p. 651, left column |
| 10. Binder | p. 26 | p. 651, left column |
| 11. Plasticizer Lubricant | p. 27 | p. 650, right column |
| 12. Coating Aid Surfactant | pp. 26 to 27 | p. 650, right column |
| 13. Antistatic Agent | p. 27 | p. 650, right column |

The color photographic material of the present invention can contain various yellow couplers. Examples of usable color couplers are described in *Research Disclosure* Item No. 17643, VII-C to G.

As magenta couplers, 5-pyrazolone compounds and pyrazoloazole compounds are preferred; and those described in U.S. Pat. Nos. 4,310,619 and 4,351,897, European Patent 73,636, U.S. Pat. Nos. 3,061,432 and 3,725,067, *Research Disclosure Item No.* 24220 (June 1984), JP-A-60-33552, *Research Disclosure Item No.* 24230 (June 1984), JP-A-60-42659 and U.S. Pat. Nos. 4,500,630 and 4,540,654 are especially preferred.

As cyan couplers, phenol couplers and naphthol couplers are preferred; and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, European Patent No. 3,329,729, European Patent 121,365A, U.S. Pat. Nos. 3,446,622, 4,333,999, 4,451,559 and 4,427,767, and European Patent 161,626A are especially preferred.

Colored couplers for correcting unnecessary absorption of colored dyes may also be incorporated into the photographic materials of the present invention. As examples of such colored couplers, those described in *Research Disclosure* Item No. 17643 VII-G, U.S. Pat. No. 4,163,670, JP-B-57-39413, U.S. Pat. Nos. 4,004,929 and 4,138,258 and British Patent 1,146,368 are preferably employed in the present invention.

Couplers capable of forming diffusive color dyes may also be incorporated into the photographic material of the invention, and those described in U.S. Pat. No. 4,366,237, British Patent 2,125,570, European Patent 96,570 and West German Patent OLS No. 3,234,533 are preferred.

Preferred examples of polymerized dye-forming couplers which may be employed in the present invention are described in U.S. Pat. Nos. 3,451,820, 4,080,211 and 4,367,282 and British Patent 2,102,173.

Couplers capable of releasing a photographically useful group with coupling may also be preferably employed in the present invention. For example, there are mentioned DIR couplers of releasing a development inhibitor, and those described in patent publications as referred to in the above-mentioned *Research Disclosure* Item No. 17643, VII-F and in JP-A-57-151944, JP-A-57-154234 and JP-A-60-184248 and U.S. Pat. No. 4,248,962 are preferred.

As couplers of imagewise releasing a nucleating agent or a development accelerator in development, those described in British Patents 2,097,140 and 2,131,188 and JP-A-59-157638 and JP-A-59-170840 are preferably employed in the present invention.

As other couplers which may be added to the photographic materials of the present invention, there are further mentioned competing couplers such as those described in U.S. Pat. No. 4,130,427; poly-valent couplers such as those described in U.S. Pat. Nos. 4,238,472, 4,338,393 and 4,310,618; DIR redox compound-releasing couplers such as those described in JP-A-60-18950; as well as couplers of releasing a dye which recolors after release therefrom such as those described in European Patent 173,302A.

Couplers for use in the present invention can be introduced into the photographic material by various known dispersion methods.

For instance, an oil-in-water dispersion method can be mentioned as one example, and examples of high boiling point organic solvents which can be used in the oil-in-water dispersion method are described in U.S. Pat. No. 2,322,027.

Another example is a latex dispersion method, and the procedure, effect and examples of latexes to be used for impregnation are described in U.S. Pat. No. 4,199,363 and West German Patent OLS Nos. 2,541,274 and 2,541,230.

The present invention may apply to multi-layer multicolor photographic materials having at least two layers each having a different color sensitivity on a support. Multi-layer natural color photographic materials generally have at least one red-sensitive emulsion layer, at least one green-sensitive emulsion layer and at least one blue-sensitive emulsion layer on a support. The order of the layers to be positioned on a support may freely be selected. As preferred examples of the sequence of the layers on a support, a red-sensitive layer, a green-sensitive layer and a blue-sensitive layer are coated on a support in this order from the side of the support. The respective emulsion layers mentioned above may be composed of two or more emulsion layers each having a different sensitivity degree. Additionally, a non-light-sensitive layer may be between two or more emulsion layers having the same color sensitivity. It is general that the red-sensitive emulsion layer contains a cyan-forming coupler, the green-sensitive emulsion layer a magenta-forming coupler, and the blue-sensitive emulsion layer an yellow-forming coupler.

It is preferred that the photographic material of the present invention has auxiliary layers, if desired, such as protective layer, interlayer, filter layer, anti-halation layer, backing layer and white reflecting layer, in addition to the above-mentioned silver halide emulsion layers. Especially preferably, the photographic material of the present invention has an yellow colloidal silver-containing yellow filter layer.

It is also preferred that the photographic material of the present invention has an anti-halation layer containing a black colloidal silver.

In preparing the photographic material of the present invention, the photographic emulsion layers and other layers are coated on a support, examples of which are described in, for example, *Research Disclosure* Item No. 17643, V to VII (December 1978), European Patent 0,102,253 and JP-A-61-97655. In coating the layers, for example, the methods described in *Research Disclosure* Item No. 17643, XV, pages 28 and 29 may be utilized.

The present invention may be applied to various kinds of color photographic materials.

For instance, there are mentioned direct positive color papers, direct positive color films, color reversal films for slide or TV, and color reversal papers, as typical examples. Additionally, it may also be applied to color hard copies for storing images by full-color duplication or CRT. Further, the present invention may also be applied to black-and-white photographic materials by admixture of three couplers, as described in *Research Disclosure* Item No. 17123 (July 1978).

Preferably, the present invention is applied to direct positive photographic materials.

Where the photographic material of the present invention is a direct positive photographic material, fogging of the material is effected by the following light-fogging and/or chemical fogging. Precisely, light-fogging is effected by complete exposure or fogging exposure, in accordance with the present invention, where the material is, after imagewise exposure, subjected to light-fogging before and/or during development. That is, the imagewise exposed material is subjected to light-fogging during dipping in a developer bath or in a pre-bath before development or immediately after taking out from the developer bath or pre-bath but before drying it. Most preferably, light-fogging is effected while the material is in a developer bath.

As a light source to be utilized for the light-fogging, anyone of emitting a light having a wavelength which falls within the wavelength range to which the photographic material is sensitive may be employed. In general, a tungsten lamp, a xenone lamp or a sun light may be used. Concrete methods for light-fogging are described in, for example, British Patent 1,151,363, JP-B-45-12710, JP-B-45-12709 and JP-B-58-6936, JP-A-48-9727, JP-A-56-137350, JP-A-57-129438, JP-A-58-62652, JP-A-58-60739, JP-A-58-70223 (corresponding to U.S. Pat. No. 4,440,851) and JP-A-58-120248 (corresponding to European Patent 89101A2). For photographic materials sensitive to a whole wavelength range, such as full-color or natural color photographic materials, light sources having a high color rendering property (preferably nearly white light source) are desired. The illuminance of the light to be applied to the photographic material is suitably from 0.01 to 2000 lux, preferably from 0.05 to 30 lux, more preferably from 0.05 to 5 lux. A photographic material having emulsions with a higher sensitivity is desired to be exposed with a light having a low illuminance. Control of the illuminance of the light source to be applied to the material may be effected by varying the luminous intensity of the light source, or by reducing the intensity of the light by means of various filters, or by varying the distance between the photographic material and the light source or the angle between the photographic material and the light source. If desired, the illuminance of the fogging light may be continuously or stepwise increased from a low illuminance to a high illuminance.

It is recommended that the photographic material to be subjected to light-fogging is dipped in a developer bath or a pre-bath and, after the processing solution has fully been penetrated into the emulsion layer of the thus dipped material, the material is irradiated for light-fogging.

On the other hand, the photographic material is also subjected to a so-called chemical fogging. In the case, a nucleating agent for chemical fogging may be incorporated into the photographic material or into a processing solution to be applied to the material. Preferably, the nucleating agent is incorporated into the photographic material.

The nucleating agent as referred to herein means a substance which functions to form a direct positive image in surface development of an unfogged internal latent image type silver halide emulsion. In the present invention, the photographic material is especially preferably fogged by the use of a nucleating agent.

Where the nucleating agent is incorporated into the photographic material, it is preferably added to the internal latent image type silver halide emulsion layer. However, so far as the nucleating agent may diffuse and adsorb to silver halide grains during coating or during processing, the agent may be added to any other layer, such as interlayer, subbing layer or backing layer.

Where the nucleating agent is added to a processing solution, it may be incorporated into a developer or a low pH-having pre-bath, as described in JP-A-58-178350.

Two or more kinds of nucleating agents may be combined and used in the present invention.

Examples of usable nucleating agents are described in, for example, JP-A 63-106506, and in particular, compounds of formulae (N-I) and (N-II) described therein are preferably employed in the present invention.

Where the nucleating agent is incorporated into the photographic material, the amount of the agent to be in the material is preferably from $10^{-8}$ to $10^{-2}$ mol, more preferably from $10^{-7}$ to $10^{-3}$ mol, per mol of the silver halide in the material.

On the other hand, where the agent is incorporated into a processing solution to be applied to the material, the amount thereof is preferably from $10^{-8}$ to $10^{-3}$ mol, preferably from $10^{-7}$ to $10^{-4}$ mol, per liter of the solution.

The color developer to be used for development of the photographic material of the present invention is preferably an alkaline aqueous solution consisting essentially of an aromatic primary amine developing agent. As the color developing agent preferred are p-phenylenediamine compounds, though aminophenol compounds may also be employed. Specific examples of usable compounds are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N ethyl-N-β-methoxyethylaniline as well as sulfates, hydrochlorides and p-toluenesulfonates thereof. These compounds may be used singly or in combination of two or more of them.

Where the photographic material is subjected to reversal processing, it is, in general, processed first with a black-and-white developer and then processed with a color developer. The black-and-white developer may contain one or more known black-and-white developing agents, for example, dihydrobenzenes such as hydroquinone, 3-pyrazolidones such as 1-phenyl-3-pyrazolidone, or aminophenols such as N-methyl-p-aminophenol.

The color developer and black-and-white developer to be used for processing the photographic material of the invention generally has a pH value of from 9 to 12. The amount of the replenisher to the developer is generally 3 liters or less per $m^2$ of the color photographic material being processed, though depending upon the material itself. However, by lowering the bromide ion concentration in the replenisher, the amount of the replenisher may be reduced to 500 ml or less.

After color-developed, the photographic emulsion layer is generally bleached. Bleaching may be effected simultaneously with fixation (bleach fixation) or separately therefrom. In order to accelerate processing, bleaching may be followed by bleach-fixation. If desired, a series of continuous two bleach-fixation bathes may be employed, or fixation may be effected prior to bleach-fixation, or bleach-fixation may be followed by bleaching. Such processing steps may freely be selected in accordance with the object. As the bleaching agent can be used compounds of poly-valent metals such as iron(III), cobalt(III), chromium(VI) or copper(II) compounds, as well as peracids, quinones and nitro compounds.

As the fixing agent can be used thiosulfates, thiocyanates, thioether compounds, thioureas and a large amount of iodides. Among them, thiosulfates are generally employed. In particular, ammonium thiosulfate is most widely used. As a preservative for the bleach-fixing solution, preferred are sulfites, bisulfites and carbonyl-bisulfite adducts.

The silver halide color photographic material of the present invention is, after desilvered, subjected to rinsing in water and/or stabilization, in general. The amount of the water to be used in the rinsing step may be defined in a broad range, in accordance with the characteristics of the photographic material to be processed (for example, raw materials of constituting the photographic material, such as couplers and others), the use thereof, as well as the temperature of the rinsing water, the number of the rinsing tanks (the stages of the rinsing step), the replenishing system in the rinsing step (countercurrent system or normal current system) and other various conditions. Among them, the relationship between the number of the rinsing tanks and the amount of the rinsing water in a multi-stage countercurrent system may be obtained by the method described in *Journal of the Society of Motion Picture and Television Engineers*, Vol. 64, pages 248 to 253 (May 1955).

Next, the present invention will be explained in more detail by way of the following examples, which, however, are not intended to restrict the scope of the present invention. All ratios and percentages are by weight unless otherwise indicated.

EXAMPLE 1

The following first to fourteenth layers were coated on the front surface of a paper support the both surfaces of which were coated with polyethylene by lamination (thickness: 100 microns), and the following fifteenth and sixteenth layers were on the back surface thereof. Accordingly a color photographic material sample was prepared. The polyethylene as laminated on the support on the side as coated with the first layer contained titanium oxide as a white pigment as well as a slight amount of ultramarine as a bluish dye. The chromaticity of the surface of the support was 88.0, −0.20, −0.75 as L*,a*,b* system.

Compositions of Photographic Layers

Components and amounts thereof (as a unit of $g/m^2$) are mentioned below. The amount of silver halide is represented by the amount of silver therein. Emulsions for the respective layers were prepared in accordance with the method of preparing Emulsion (EM1) which will be mentioned below. However, the emulsion of the fourteenth layer was a Lippman emulsion which was not subjected to surface chemical sensitization.

| | |
|---|---|
| First Layer: Anti-Halation Layer | |
| Black colloidal silver | 0.10 |
| Gelatin | 0.70 |
| Second Layer: Interlayer | |
| Gelatin | 0.70 |
| Third Layer: Low-Sensitivity Red-Sensitive Layer | |
| Silver bromide as color-sensitized with red-sensitizing dyes (IX-17, IX-10, ExS-3) (mean grain size 0.25 micron; grain size distribution (fluctuation coefficient) 8%; octahedral grains) | 0.04 |
| Silver chlorobromide as color-sensitized with red-sensitizing dyes (IX-17, IX-10, ExS-3) (silver chloride 5 mol %; mean grain size 0.40 micron; grain size distribution 10%; octahedral grains) | 0.08 |
| Gelatin | 1.00 |
| Cyan couplers (ExC-1/ExC-2/ExC-3 of 1/1/0.2) | 0.30 |
| Anti-fading agent (Cpd-1/Cpd-2/ Cpd-3/Cpd-4 of 1/1/1/1) | 0.18 |
| Stain inhibitor (Cpd-5) | 0.003 |
| Coupler dispersion medium (Cpd-6) | 0.03 |
| Coupler solvent (Solv-1/Solv-2/Solv-3 of 1/1/1) | 0.12 |
| Fourth Layer: High-Sensitivity Red-Sensitive Layer | |
| Silver bromide as color-sensitized with red-sensitizing dyes (IX-17, IX-10, ExS-3) (mean grain size 0.60 micron; grain size distribution 15%; octahedral grains) | 0.14 |
| Gelatin | 1.00 |
| Cyan couplers (ExC-1/ExC-2/ExC-3 of 1/1/0.2) | 0.30 |
| Anti-fading agent (Cpd-1/Cpd-2/ Cpd-3/Cpd-4 of 1/1/1/1) | 0.18 |
| Coupler dispersion medium (Cpd-6) | 0.03 |
| Coupler solvent (Solv-1/Solv-2/Solv-3 of 1/1/1) | 0.12 |
| Fifth layer: Interlayer | |
| Gelatin | 1.00 |
| Color mixing preventing agent (Cpd-7) | 0.08 |
| Color mixing preventing agent solvent (Solv-4/Solv-5 of 1/1) | 0.16 |
| Polymer latex (Cpd-8) | 0.10 |
| Sixth Layer: Low-Sensitivity Green-Sensitive Layer | |
| Silver bromide as color-sensitized with green-sensitizing dyes (ExS-4) (mean grain size 0.25 micron; grain size distribution 8%; octahedral grains) | 0.04 |
| Silver chlorobromide as color-sensitized with green-sensitizing dye (ExS-4) (silver chloride 5 mol %; mean grain size 0.40 micron; grain size distribution 10%; octahedral grains) | 0.06 |
| Gelatin | 0.80 |
| Magenta couplers (ExM-1/ExM-2/ExM-3 of 1/1/1) | 0.11 |
| Anti-fading agent (Cpd-9/Cpd-26 of 1/1) | 0.15 |
| Stain inhibitor (Cpd-10/ Cpd-11/ Cpd-12/Cpd-13 of 10/7/7/1) | 0.025 |
| Coupler dispersion medium (Cpd-6) | 0.05 |
| Coupler solvent (Solv-4/Solv-6 of 1/1) | 0.15 |
| Seventh Layer: High-Sensitivity Green-Sensitive Layer | |
| Silver bromide as color-sensitized with green-sensitizing dyes (ExS-4) (mean grain size 0.65 micron; grain size distribution 16%; octahedral grains) | 0.10 |
| Gelatin | 0.80 |
| Magenta couplers (ExM-1/ExM-2/ExM-3 of 1/1/1) | 0.11 |
| Anti-fading agent (Cpd-9/Cpd-26 of 1/1) | 0.15 |
| Stain inhibitor (Cpd-10/Cpd-11/ Cpd-12/Cpd-13 of 10/7/7/1) | 0.025 |
| Coupler dispersion medium (Cpd-6) | 0.05 |
| Coupler solvent (Solv-4/Solv-6 of 1/1) | 0.15 |
| Eighth Layer: Interlayer | |
| Same as Fifth Layer | |
| Ninth Layer: Yellow Filter Layer | |
| Yellow colloidal silver | 0.12 |
| Gelatin | 0.07 |
| Color mixing preventing agent (Cpd-7) | 0.03 |
| Color mixing preventing agent solvent (Solv-4/Solv-5 of 1/1) | 0.10 |
| Polymer latex (Cpd-8) | 0.07 |
| Tenth Layer: Interlayer | |
| Same as Fifth Layer | |
| Eleventh Layer: Low-Sensitivity Blue-Sensitive Layer | |
| Silver bromide as color-sensitized with blue-sensitizing dyes (ExS-5, ExS-6) (mean grain size 0.40 micron; grain size distribution 8%; octahedral grains) | 0.07 |
| Silver chlorobromide as color-sensitized with blue-sensitizing dye (ExS-5, ExS-6) (silver chloride 8 mol %; mean grain size 0.60 micron; grain size distribution 11%; octahedral grains) | 0.14 |
| Gelatin | 0.80 |
| Yellow couplers (ExY-1/ExY-2 of 1/1) | 0.35 |
| Anti-fading agent (Cpd-14) | 0.10 |
| Stain inhibitor (Cpd-5/Cpd-15 of 1/5) | 0.007 |
| Coupler dispersion medium (Cpd-6) | 0.05 |
| Coupler solvent (Solv-2) | 0.10 |
| Twelfth Layer: High-Sensitivity Blue-Sensitive Layer | |
| Silver bromide as color-sensitized with blue-sensitizing dyes (ExS-5, ExS-6) (mean grain size 0.85 micron; grain size distribution 18%; octahedral grains) | 0.15 |
| Gelatin | 0.60 |
| Yellow couplers (ExY-1/ExY-2 of 1/1) | 0.30 |
| Anti-fading agent (Cpd-14) | 0.10 |
| Stain inhibitor (Cpd-5/Cpd-15 of 1/5) | 0.007 |
| Coupler dispersion medium (Cpd-6) | 0.05 |
| Coupler solvent (Solv-2) | 0.10 |
| Thirteenth Layer: Ultraviolet Absorbing Layer | |
| Gelatin | 1.00 |
| Ultraviolet absorbent (Cpd-2/Cpd-4/Cpd-16 of 1/1/1) | 0.50 |
| Color mixing preventing agent (Cpd-7/Cpd-17 of 1/1) | 0.03 |
| Dispersion medium (Cpd-6) | 0.02 |
| Ultraviolet absorbent solvent (Solv-2/Solv-7 of 1/1) | 0.08 |
| Anti-irradiation dyes (Cpd-18/Cpd-19/ | 0.05 |

-continued

| | |
|---|---|
| Cpd-20/Cpd-21 of 10/10/13/15) | |
| Fourteenth Layer: Protective Layer | |
| Fine silver chlorobromide grains (silver chloride 97 mol %; mean grain size 0.1 micron) | 0.03 |
| Acryl-modified copolymer of polyvinyl alcohol | 0.01 |
| Mixture (1/1) of polymethyl methacrylate grains (mean grain size 2.4 microns) and silicon oxide grains (mean grain size 5 microns) | 0.05 |
| Gelatin | 1.80 |
| Gelatin hardening agent (H-1/H-2 of 1/1) | 0.18 |
| Fifteenth Layer: Backing Layer | |
| Gelatin | 2.50 |
| Ultraviolet absorbent (Cpd-2/Cpd-4/Cpd-16 of 1/1/1) | 0.50 |
| Dyes (Cpd-18/Cpd-19/Cpd-20/Cpd-21 of 1/1/1/1) | 0.06 |
| Sixteenth Layer: Backing Protective Layer | |
| Mixture (1/1) of polymethyl methacrylate grains (mean grain size 2.4 microns) and silicon oxide grains (mean grain size 5 microns) | 0.05 |
| Gelatin | 2.00 |
| Gelatin hardening agent (H-1/H-2 of 1/1) | 0.14 |

Preparation of Emulsion EM-1

An aqueous solution of potassium bromide and an aqueous solution of silver nitrate were simultaneously added to an aqueous solution of gelatin at 75° C. over a period of 15 minutes with vigorously stirring, to form octahedral silver bromide grains having a mean grain size of 0.40 micron. To the emulsion were added 0.3 g per mol of silver of 3,4-dimethyl-1,3-thiazolin-2-thione, 6 mg per mol of silver of sodium thiosulfate and 7 mg per mol of silver of chloroauric acid (4-hydrate) in order, which was then heated at 75° C. for 80 minutes for chemical sensitization. The thus formed grains were core grains and were further grown under the same sedimentation condition as the first step to finally obtain an octahedral monodispersed core/shell silver bromide emulsion having a mean grain size of 0.7 micron. This had a grain size fluctuation coefficient of about 10%. To the emulsion were added 1.5 mg per mol of silver of sodium thiosulfate and 1.5 mg per mol of silver of chloroauric acid (4-hydrate), which was then heated at 60° C. for 60 minutes for chemical sensitization. Accordingly, an internal latent image type silver halide emulsion was obtained.

The respective light-sensitive layers contained nucleating agents of ExZK-1 and ExZK-2 in amounts of $10^{-3}$% by weight and $10^{-2}$% by weight, respectively and a nucleating accelerator of Cpd-22 in an amount of weight per silver halide. Additionally, the respective layers further contained emulsifying and dispersion aids of Alkanol XC (product by E. I. DuPont de Nemours & Co.) and sodium alkylbenzene-sulfonate and coating aids of succinate and Magefac F-120 (product by Dainippon Ink & Chemicals, Inc.). The silver halide-containing layers and colloidal silver-containing layers contained a stabilizer comprising Cpd-23, Cpd-24 and Cpd-25. The sample thus prepared was called Sample No. 1. The compounds used in preparing the sample are shown below.

ExS-3

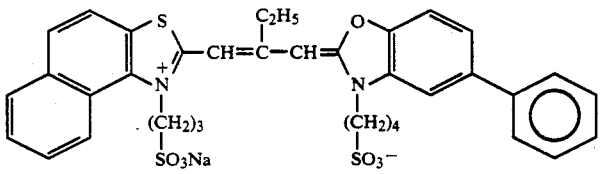

Exs-4

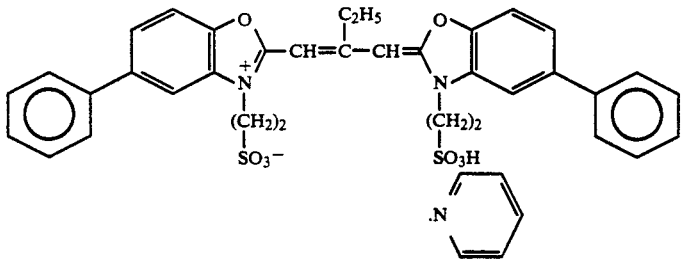

ExS-5

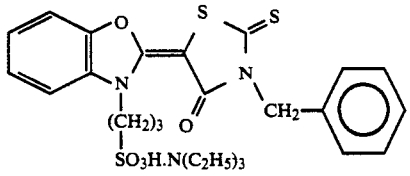

ExS-6

-continued
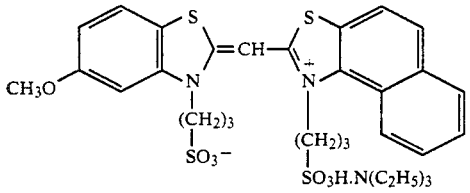
Cpd-1
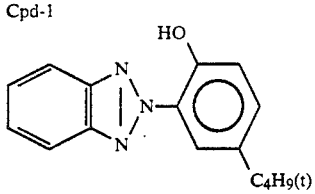
Cpd-2
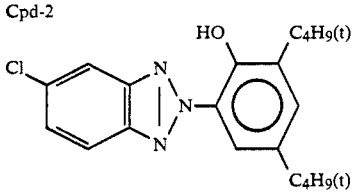
Cpd-3
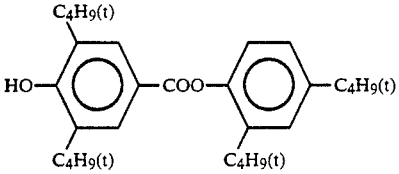
Cpd-4
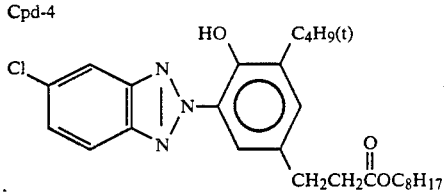
Cpd-5
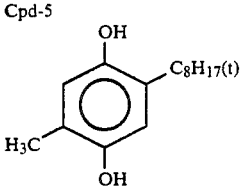
Cpd-6
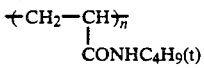
n = 100 ~ 1000
Cpd-7
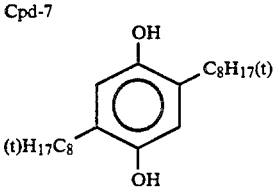
Cpd-8
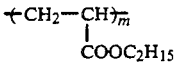

-continued
Cpd-9
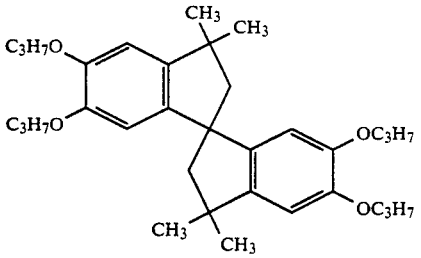
Cpd-10
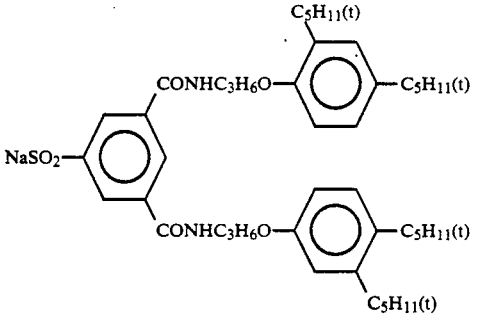
Cpd-11
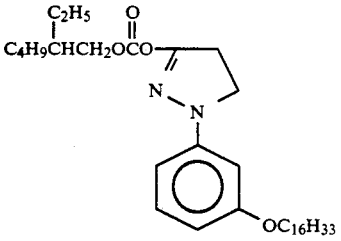
Cpd-12
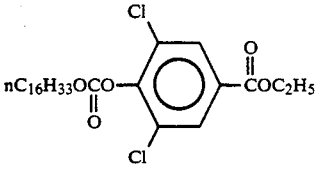
Cpd-13
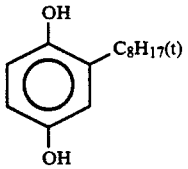
Cpd-14
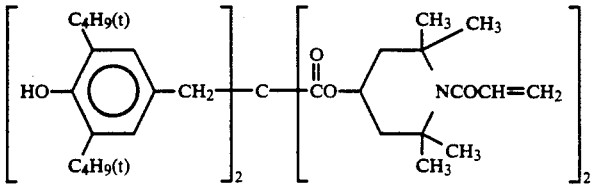
Cpd-15

-continued
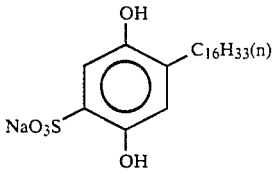
Cpd-16
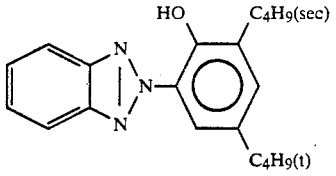
Cpd-17
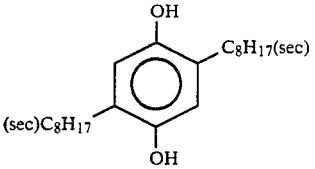
Cpd-18
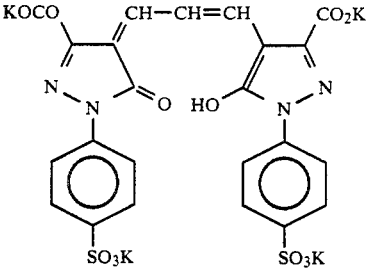
Cpd-19
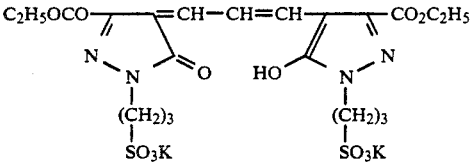
Cpd-20
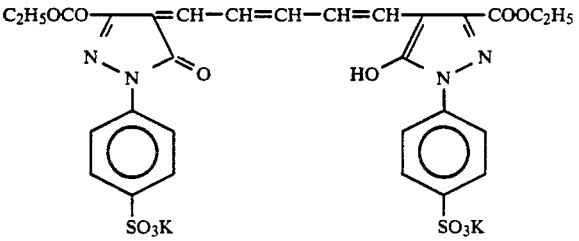
Cpd-21

-continued
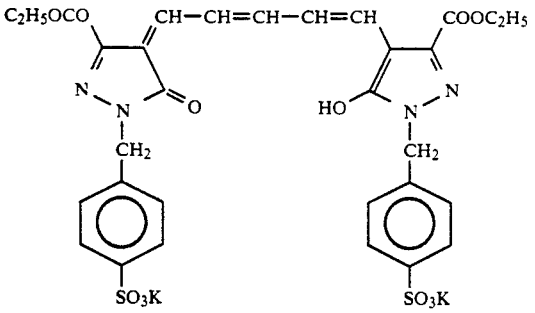
Cpd-22
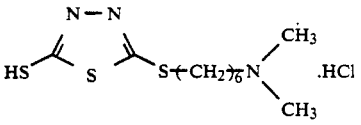
Cpd-23
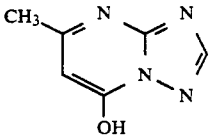
Cpd-24
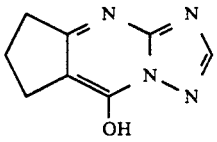
Cpd-25
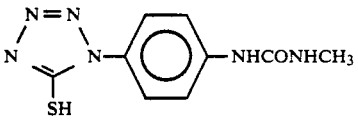
Cpd-26
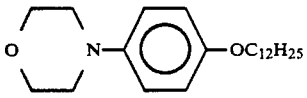
ExC-1
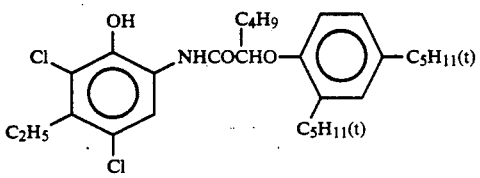
ExC-2
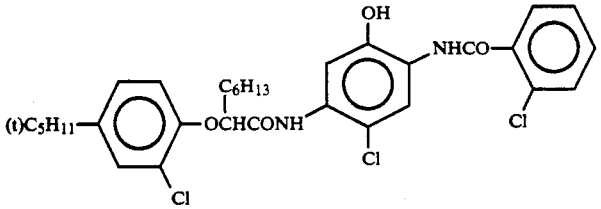
ExC-3

-continued
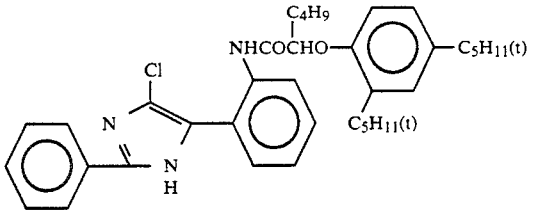
ExM-1
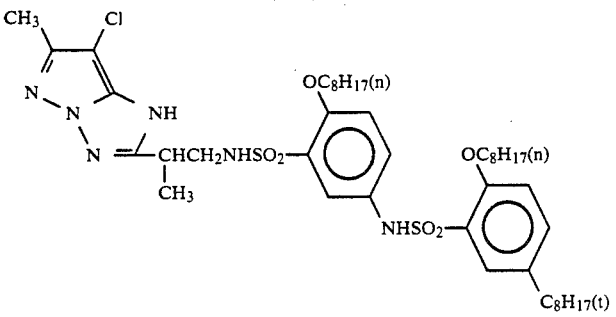
ExM-2
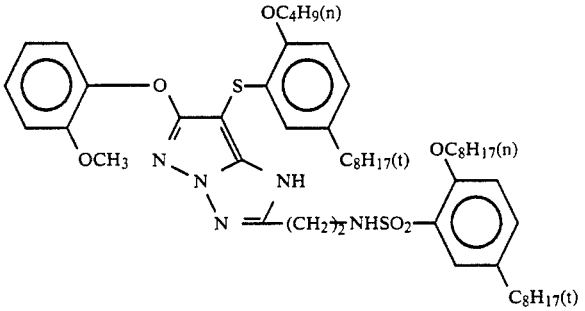
ExM-3
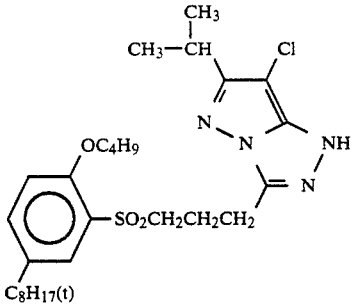
ExY-1
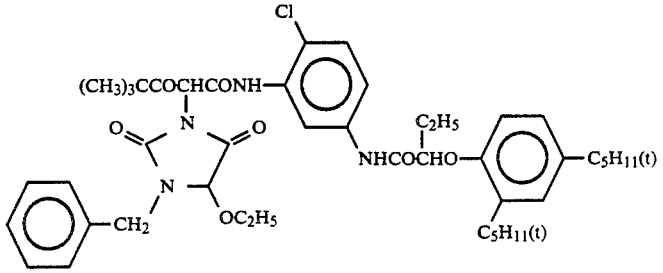
ExY-2

-continued

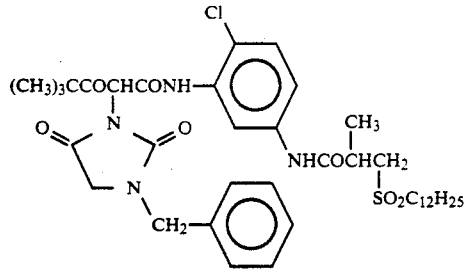

Solv-1: Di(2-ethylexyl) sebacate
Solv-2: Trinonyl phosphate
Solv-3: Di(3-methylhexyl) phthalate
Solv-4: Tricresyl phosphate
Solv-5: Dibutyl phthalate
Solv-6: Trioctyl phosphate
Solv-7: Di(2-ethylhexyl) phthalate
H-1: 1,2-Bis(vinylsulfonylacetamido)ethane
H-2: 4,6-Dichloro-2-hydroxy-1,3,5-triazine sodium salt ExZK-1: 7-(3-Ethoxythiocarbonylaminobenzamido)-9-methyl-10-propargyl-1,2,3,4-tetrahydroacryldinium trifluoromethanesulfate ExZK-2: 2-[4-{3-[3-{3-[5-{3-[2-Chloro-5-(1-dodecyloxycarbonylethoxycarbonyl)phenylcarbamoyl]-4-hydroxy-1-naphthylthio}tetrazol-1-yl]-phenyl}ureido]benzenesulfonamido}phenyl-1-formylhydrazine Sample No. 1 was continuously processed with an automatic developing machine in accordance with the processing steps mentioned below, until the total amount of the replenisher used became three times of the tank capacity. The thus fatigued solution was used for processing other photographic material samples mentioned below.

| Processing Steps | Time | Temp. | Mother Solution Tank Capacity | Amount of Replenisher |
|---|---|---|---|---|
| Color development | 135 sec | 38° C. | 15 liters | 300 ml/m$^2$ |
| Bleach-fixation | 40 sec | 33° C. | 3 liters | 300 ml/m$^2$ |
| Rinsing (1) | 40 sec | 33° C. | 3 liters | — |
| Rinsing (2) | 40 sec | 33° C. | 3 liters | 320 ml/m$^2$ |
| Drying | 30 sec | 80° C. | | |

The system of replenishing the rinsing water was a so-called countercurrent replenishment system where the replenisher was replenished to the rinsing bath (2) and the overflow from the rinsing bath(2) was introduced into the rinsing bath(1). In the procedure, the amount of the carryover of the bleach-fixing solution with the photographic material from the bleach-fixation bath to the rinsing bath (1) was 35 ml/m$^2$, and the magnification of the amount of the replenisher of the rinsing water to that of the carryover of the bleach-fixing solution was 9.1 times.

The processing solution had the following compositions.

Color Developer:

| | Mother Solution | Replenisher |
|---|---|---|
| D-sorbitol | 0.15 g | 0.20 g |
| Sodium naphthalenesulfonate/formalin condensate | 0.15 g | 0.20 g |
| Ethylenediamine-tetrakis-methylenephosphonic acid | 1.5 g | 1.5 g |
| Diethylene glycol | 12.0 ml | 16.0 ml |

-continued

| | | |
|---|---|---|
| Benzyl alcohol | 13.5 ml | 18.0 ml |
| Potassium bromide | 0.80 g | — |
| Benzotriazole | 0.003 g | 0.004 g |
| Potassium sulfite | 2.4 g | 3.2 g |
| N,N-bis(carboxymethyl)hydrazine | 6.0 g | 8.0 g |
| D-glucose | 2.0 g | 2.4 g |
| Triethanolamine | 6.0 g | 8.0 g |
| N-ethyl-N-(β-methanesulfonamido-ethyl)-3-methyl-4-aminoaniline sulfate | 6.4 g | 8.5 g |
| Potassium carbonate | 30.0 g | 25.0 g |
| Brightening agent (diaminostilbene type compound) | 1.0 g | 1.2 g |
| Water to make | 1000 ml | 1000 ml |
| pH (25° C.) | 10.25 | 10.75 |

Bleach-Fixing Solution:

| | Mother Solution | Replenisher (Same as Mother Solution) |
|---|---|---|
| Disodium ethylenediamine-tetraacetate dihydrate | 4.0 g | |
| Ammonium ethylenediamine-tetraacetato/Fe(III) dihydrate | 70.0 g | |
| Ammonium thiosulfate (700 g/liter) | 180 ml | |
| Sodium P-toluenesulfinate | 20.0 g | |
| Sodium bisulfite | 20.0 g | |
| Ammonium nitrate | 10.0 g | |
| Water to make | 1000 ml | |
| pH (25° C.) | 6.20 | |

Rinsing Water: Mother solution and replenisher were same.

A city water was passed through a mixed bed column as filled with an H-type strong acidic cation-exchange resin (Amberlite IR-120B, manufactured by Rhom & Haas Co.) and an OH-type anion-exchange resin (Amberlite IR-400, manufactured by Rhom & Haas Co.) so that both the calcium ion concentration and the magnesium ion concentration were reduced to 3 mg/liter or less. Next, 20 mg/liter of sodium dichloriso cyanurate and 1.5 g/liter of sodium sulfate were added thereto. The resulting solution had a pH value of falling within the range of from 6.5 to 7.5.

Using compounds of the invention or comparative compound along with or in place of the anti irradiation dye in the thirteenth layer., Samples Nos. 2 to 10 were prepared.

Precisely, the constitution of each of Samples Nos. 2 to 10 was shown in Table 1 below. In order to evaluate the color-reproducibility of the samples, each sample was subjected to the following test. Macbeth Color Checker was photographed with a color negative film (SHR-100, product by Fuji Photo Film Co.), which was then printed on a color paper (02 Ⓐ, product by Fuji Photo Film Co.) to prepare a color original. The original was printed on each of Samples Nos. 2 to 10 by the use of a reflection printer, and the thus printed samples were then processed in accordance with the processing procedure mentioned above. Accordingly, color prints were obtained. The density and color of each print was so adjusted that the gray patch of Neutral 5 of Macbeth Color Checker on the color paper original could give a gray having a density of 1.0 on the print.

HVC values by corrected Munsell system were measured in the red, green and blue color patches of the Macbeth Color Checker on the thus obtained print, and C value was shown in Table 1. Where the sample tested has a higher C value, it has a higher color-reproducibility with respect to the saturation of the color. Additionally, it has been confirmed that the value corresponds to the visual color vividness of the image on the print.

TABLE 1

| Sample No. | | Dyes Added to 13th Layer and Amounts thereof ($g/m^2$) | C Value of Color Patch on Print | | | Stains on Processed Sample (C Density) |
|---|---|---|---|---|---|---|
| | | | Red | Green | Blue | |
| 1 | Comp. Ex. | Cpd-18 0.010<br>19 0.010<br>20 0.014<br>21 0.016 | 9.0 | 7.1 | 5.8 | 0.23 |
| 2 | " | Cpd-18 0.025<br>19 0.010<br>20 0.014<br>21 0.016 | 8.9 | 7.1 | 5.6 | 0.26 |
| 3 | " | Cpd-18 0.010<br>19 0.010<br>20 0.019<br>21 0.016 | 9.0 | 7.2 | 5.8 | 0.28 |
| 4 | Invention | Cpd-18 0.010<br>19 0.010<br>20 0.014<br>21 0.016<br>I-1 0.020 | 9.5 | 7.6 | 5.9 | 0.23 |
| 5 | " | Cpd-18 0.008<br>19 0.008<br>20 0.010<br>21 0.010<br>I-9 0.025 | 9.7 | 7.8 | 5.9 | 0.21 |
| 6 | " | Cpd-18 0.010<br>19 0.010<br>20 0.014<br>21 0.016<br>I-3 0.015 | 9.2 | 7.3 | 6.2 | 0.23 |
| 7 | " | Cpd-18 0.005<br>19 0.005<br>20 0.014<br>21 0.016<br>I-4 0.018 | 9.1 | 7.5 | 6.3 | 0.22 |
| 8 | Invention | Cpd-18 0.005<br>19 0.005<br>20 0.008<br>21 0.008<br>I-1 0.015<br>I-3 0.020 | 9.7 | 7.8 | 6.3 | 0.20 |
| 9 | " | Cpd-18 0.005<br>19 0.005<br>20 0.008<br>21 0.008<br>I-9 0.020<br>I-4 0.018 | 9.8 | 7.9 | 6.3 | 0.21 |
| 10 | " | I-9 0.022<br>I-4 0.022 | 9.7 | 7.9 | 6.4 | 0.20 |

As is obvious from the results shown in Table 1 above, C value of anyone or all of red, green and blue color patches was larger in Samples Nos. 4 to 10 of the present invention, than that in Comparative Samples Nos. 1 to 3. That is, all the samples of the present invention gave prints having an elevated color saturation and had an improved color-reproducibility.

EXAMPLE 2

Samples Nos. 11 to 14 were prepared in the same manner as in Example 1, using dyes (Cpd-27, Cpd-28) as described in JP-A-1-106047.

Cpd-27:

-continued

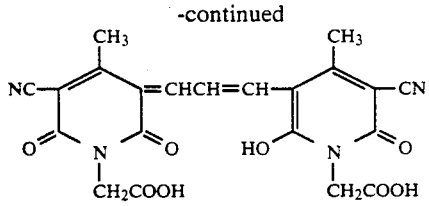

Cpd-28:

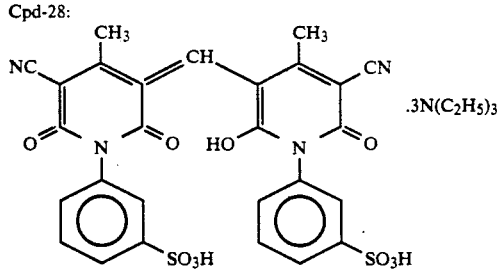

The amounts of the dyes as added to Sample Nos. 11 to 14 are shown in Table 2 below.

These Samples Nos. 11 to 14 were processed in the same manner as in Example 1, whereupon a bleaching accelerator described above was added to the bleach-fixing solution. Precisely, the amount of Compound (IV)-(3) or (V)-(1) as added was 0.3 g per liter of the bleach-fixing solution. The amount of the silver as remained in the maximum density portion of each of the thus processed samples is shown in Table 3 below, which was measured by a fluorescent X-ray method. Table 3 also shows C values of red and blue color patches on the print, for the purpose of evaluating the color-reproducibility of each sample in the same way as in Example 1.

TABLE 2

| Sample No. | | Dyes Added to 13th Layer and Amounts Thereof ($g/m^2$) |
|---|---|---|
| 11 | Comp. Ex. | Cpd-18 0.008 |
| | | 19 0.008 |
| | | 20 0.010 |
| | | 21 0.010 |
| | | Cpd-27 0.020 |
| 12 | " | Cpd-18 0.005 |
| | | 19 0.005 |
| | | 20 0.014 |
| | | 21 0.016 |
| | | Cpd-28 0.020 |
| 13 | " | Cpd-18 0.005 |
| | | 19 0.005 |
| | | 20 0.008 |

TABLE 2-continued

| Sample No. | | Dyes Added to 13th Layer and Amounts Thereof ($g/m^2$) |
|---|---|---|
| | | 21 0.008 |
| | | Cpd-27 0.015 |
| | | 28 0.015 |
| 14 | " | Cpd-27 0.020 |
| | | 28 0.020 |

TABLE 3

| | Compound Added to Bleach-Fixing Solution | Amount of Silver Remained in Maximum Density Portion ($\mu g/cm^2$) | | | C Value | |
|---|---|---|---|---|---|---|
| | | None | (IV)-(3) | (V)-(1) | Red (V)-(1) | Green (V)-(1) |
| 1 | Comp. Ex. | 11.8 | 6.0 | 6.2 | 10.0 | 6.5 |
| 2 | " | 12.0 | 6.0 | 6.0 | 10.2 | 6.4 |
| 3 | " | 11.5 | 5.7 | 6.0 | 10.0 | 6.3 |
| 4 | Invention | 10.8 | 5.6 | 5.2 | 10.9 | 6.5 |
| 5 | " | 10.5 | 3.5 | 4.1 | 10.9 | 6.4 |
| 6 | " | 11.0 | 5.7 | 5.6 | 10.5 | 7.1 |
| 7 | " | 10.8 | 3.4 | 3.8 | 10.5 | 7.0 |
| 8 | " | 10.7 | 3.0 | 2.9 | 11.0 | 7.0 |
| 9 | " | 10.8 | 3.0 | 3.3 | 10.9 | 7.0 |
| 10 | " | 10.5 | 2.0 | 2.5 | 11.2 | 7.1 |
| 11 | Comp. Ex. | 11.8 | 6.9 | 7.3 | 10.9 | 6.5 |
| 12 | " | 11.7 | 7.2 | 7.5 | 10.4 | 7.0 |
| 13 | " | 11.5 | 7.5 | 7.5 | 10.9 | 6.9 |
| 14 | " | 11.5 | 7.5 | 7.7 | 10.8 | 6.9 |

The results in Table 3 apparently demonstrate that the amount of the silver as remaining in the processed photographic samples noticeably decreased in accordance with the present invention and the processed samples therefore had an improved color-reproducibility.

EXAMPLE 3

Samples Nos. 1, 5 and 11 were processed in the same manner as in Example 1. To examine the case where the bleach-fix bath was fatigued, the bleach-fix time was changed to 30 seconds. The results are shown Table 4.

TABLE 4

| Sample No. | | Dyes Added to 13th Layer and Amounts Thereof ($g/m^2$) | Addition of Colloidal Silver | Amount of Silver in Maximum Density Portion ($\mu g/cm^2$) | |
|---|---|---|---|---|---|
| | | | | Bleach-fix 40 sec. | Bleach-fix 30 sec. |
| 1 | Comp. Ex. | Cpd-18 0.010 | Yes | 11.5 | 22.5 |
| | | 19 0.010 | | | |
| | | 20 0.014 | | | |
| | | 21 0.016 | | | |
| 5 | Invention | Cpd-18 0.008 | Yes | 10.5 | 13.8 |
| | | 19 0.008 | | | |
| | | 20 0.010 | | | |
| | | 21 0.010 | | | |
| | | I-9 0.025 | | | |
| 11 | Comp. Ex. | Cpd-18 0.008 | Yes | 11.8 | 20.4 |
| | | 19 0.008 | | | |
| | | 20 0.010 | | | |
| | | 21 0.010 | | | |
| | | Cpd-27 0.020 | | | |

From the results in Table 4 above, it is obvious that Sample No. 5 of the present invention had a noticeably reduced amount of silver as remained in the processed sample. In particular, this effect is remarkable when the processing solution is fatigued.

EXAMPLE 4

In order to examine the effect attainable by the use of the sensitizing dyes of the present invention, the following comparison was effected.

Precisely, Samples Nos. 15 to 24 were prepared in the same manner as in Preparation of Samples Nos. 1 to 10 in Example 1, respectively, except that the following compound (a) was used in place of the red-sensitizing dyes ExS-1, ExS-2 and ExS-3 in the third and fourth layers.

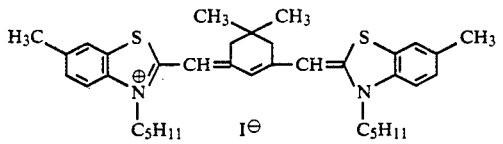

These samples were exposed by the use of a silver-plated continuous wedge and then processed in the same manner as in Example 1.

The amount of the silver as remained in the maximum density portion in each of the thus processed samples was obtained in the same manner as in Example 2. Additionally, the cyan density in the Dmin portion of each sample was measured. The results obtained are shown in Table 5 below.

Samples Nos. 15 to 24 were subjected to a color-reproducibility test in the same manner as in Example 1. As compared with Samples Nos. 15 to 17, Samples No. 18 to 24 had an increased C value in anyone or all of red, green and blue patches. That is, the latter samples gave prints having an elevated color saturation and had an improved color-reproducibility.

However, from the results in Table 5, it is understood that the amount of the silver as remained in the maximum density portion as well as the cyan density in the Dmin portion (Dmin (C)) noticeably decreased only in the samples containing the red-sensitizing dye(s) of the present invention.

TABLE 5

| Sample No. | | Dyes Added to 13th Layer and Amount Thereof (g/m$^2$) | Red-Sensitizing Dyes Used in 3rd and 4th Layers | Silver Remained in Maximum Density Portion (μg/cm$^2$) | D min (C) |
|---|---|---|---|---|---|
| 1 | Comp. Ex. | Cpd-18 0.010 | IX-17 | 11.8 | 0.32 |
| | | 19 0.010 | IX-10 | | |
| | | 20 0.014 | | | |
| | | 21 0.016 | | | |
| 2 | " | Cpd-18 0.025 | IX-17 | 12.0 | 0.34 |
| | | 19 0.010 | IX-10 | | |
| | | 20 0.014 | | | |
| | | 21 0.016 | | | |
| 3 | " | Cpd-18 0.010 | IX-17 | 11.5 | 0.33 |
| | | 19 0.010 | IX-10 | | |
| | | 20 0.019 | | | |
| | | 21 0.016 | | | |
| 4 | Invention | Cpd-18 0.010 | IX-17 | 10.8 | 0.22 |
| | | 19 0.010 | IX-10 | | |
| | | 20 0.014 | | | |
| | | 21 0.016 | | | |
| | | I-1 0.020 | | | |
| 5 | " | Cpd-18 0.008 | IX-17 | 10.5 | 0.20 |
| | | 19 0.008 | IX-10 | | |
| | | 20 0.010 | | | |
| | | 21 0.010 | | | |
| | | I-9 0.020 | | | |
| 6 | " | Cpd-18 0.010 | IX-17 | 11.0 | 0.19 |
| | | 19 0.010 | IX-10 | | |
| | | 20 0.014 | | | |
| | | 21 0.016 | | | |
| | | I-3 0.015 | | | |
| 7 | " | Cpd-18 0.005 | IX-17 | 10.8 | 0.17 |
| | | 19 0.005 | IX-10 | | |
| | | 20 0.014 | | | |
| | | 21 0.016 | | | |
| | | I-4 0.018 | | | |
| 8 | Invention | Cpd-18 0.005 | IX-17 | 10.7 | 0.18 |
| | | 19 0.005 | IX-10 | | |
| | | 20 0.008 | | | |
| | | 21 0.008 | | | |
| | | I-1 0.015 | | | |
| | | I-3 0.020 | | | |
| 9 | " | Cpd-18 0.005 | IX-17 | 10.8 | 0.18 |
| | | 19 0.005 | IX-10 | | |
| | | 20 0.008 | | | |
| | | 21 0.008 | | | |
| | | I-9 0.020 | | | |
| | | I-4 0.018 | | | |
| 10 | " | I-9 0.022 | IX-17 | 10.5 | 0.16 |
| | | I-4 0.022 | IX-10 | | |
| 15 | Comp. Ex. | Cpd-18 0.010 | Compound (a) | 12.5 | 0.38 |
| | | 19 0.010 | | | |
| | | 20 0.014 | | | |
| | | 21 0.016 | | | |
| 16 | " | Cpd-18 0.025 | " | 12.5 | 0.35 |
| | | 19 0.010 | | | |

TABLE 5-continued

| Sample No. | | Dyes Added to 13th Layer and Amount Thereof (g/m²) | Red-Sensitizing Dyes Used in 3rd and 4th Layers | Silver Remained in Maximum Density Portion (μg/cm²) | D min (C) |
|---|---|---|---|---|---|
| | | 20 0.014 | | | |
| | | 21 0.16 | | | |
| 17 | " | Cpd-18 0.010 | " | 12.0 | 0.36 |
| | | 19 0.010 | | | |
| | | 20 0.019 | | | |
| | | 21 0.016 | | | |
| 18 | Invention | Cpd-18 0.010 | " | 12.3 | 0.35 |
| | | 19 0.010 | | | |
| | | 20 0.014 | | | |
| | | 21 0.016 | | | |
| | | I-1 0.020 | | | |
| 19 | Invention | Cpd-18 0.008 | Compound (a) | 12.2 | 0.35 |
| | | 19 0.008 | | | |
| | | 20 0.010 | | | |
| | | 21 0.010 | | | |
| | | I-9 0.025 | | | |
| 20 | " | Cpd-18 0.010 | " | 12.2 | 0.36 |
| | | 19 0.010 | | | |
| | | 20 0.014 | | | |
| | | 21 0.016 | | | |
| | | I-3 0.015 | | | |
| 21 | " | Cpd-18 0.005 | " | 12.5 | 0.32 |
| | | 19 0.005 | | | |
| | | 20 0.014 | | | |
| | | 21 0.016 | | | |
| | | I-4 0.018 | | | |
| 22 | " | Cpd-18 0.005 | " | 12.3 | 0.35 |
| | | 19 0.005 | | | |
| | | 20 0.008 | | | |
| | | 21 0.008 | | | |
| | | I-1 0.015 | | | |
| | | I-3 0.020 | | | |
| 23 | " | Cpd-18 0.005 | " | 12.5 | 0.32 |
| | | 19 0.005 | | | |
| | | 20 0.008 | | | |
| | | 21 0.008 | | | |
| | | I-9 0.020 | | | |
| | | I-4 0.018 | | | |
| 24 | " | I-9 0.022 | " | 12.5 | 0.35 |
| | | I-4 0.022 | | | |

EXAMPLE 5

Sample Nos. 25 to 28 were prepared in the same manner as Sample No. 1 of Example 1 except that an additional dye in 13th layer was added as shown in Table 6. The spectral sensitivity distributions of Sample Nos. 25 to 28 were determined. Then $\lambda_{smax}$ (a wavelength at the spectral maximum sensitivity, Smax), $\lambda_{smax-0.1}$ (a wavelength in the short wavelength side in which the sensitivity is lower than that of $\lambda_{smax}$ by 0.1), and $\lambda_{smax-0.6}$ (a wavelength in the short wavelength side in which the sensitivity is lower than that of $\lambda_{smax}$ by 0.6) of Sample Nos. 25 to 28 were determined. These results and the results of color reproduction test are shown in Table 6.

TABLE 6

| Sample No. | Additional Dyes Added to 13th Layer and Amount Thereof (g/m³) | $\lambda_{smax}$ (nm) | $\lambda_{smax-0.1}$ (nm) | $\lambda_{smax-0.6}$ (nm) | $(\lambda_{smax-0.1}) - \lambda_{smax-0.6}$ (nm) | Color Reproduction (Chroma): Red | Remarks |
|---|---|---|---|---|---|---|---|
| 25 | none | 650 | 635 | 576 | 59 | 8.8 | Comparison |
| 26 | Cpd-27 0.020<br>Cpd-28 0.020 | 648 | 638 | 600 | 38 | 9.2 | Comparison |
| 27 | I-9 0.025 | 648 | 638 | 618 | 19 | 10.8 | Invention |
| 28 | I-2 0.025 | 648 | 638 | 611 | 27 | 10.0 | Invention |

As is apparent from Table 6, color reproduction of the present invention is improved.

While the invention has been described in detail and with reference to specific embodiments thereof, it will be apparent to one skilled in the art that various changes and modifications can be made therein without departing from the spirit and scope thereof.

What is claimed is:

1. A positive-positive silver halide color photographic material comprising at least one red-sensitive silver halide emulsion layer, at least one green-sensitive silver halide emulsion layer, at least one blue-sensitive silver halide emulsion layer, at least one hydrophilic colloid layer, and at least one colloidal silver layer on a support wherein said silver halide emulsion layer, hydrophilic colloid layer, or colloidal silver layer contains at least one dye of formula (I):

(I)

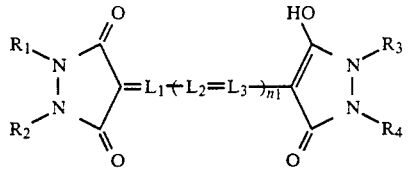

where $R_1$, $R_2$, $R_3$ and $R_4$ are the same or different and each represents an alkyl group, an aryl group or a hetercyclic group; $L_1$, $L_2$ and $L_3$ each represents a methine group; $n_1$ represents 1 or 2; and any of $R_1$, $R_2$, $R_3$ and $R_4$ has a sulfo group and the total of the groups is at least two or more.

2. The positive-positive silver halide color photographic material as claimed in claim 1, which further contains a compound of formula (IX):

(IX)

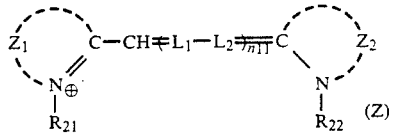

(Z)

where $Z_1$ and $Z_2$ are the same or different and each represents an atomic group necessary for forming a benzothiazole nucleus, a naphthothiazole nucleus, a benzoselenazole nucleus or a naphthoselenazole nucleus; $R_{21}$ and $R_{22}$ are the same or different and each represents an alkyl group, provided that at least one of $R_{21}$ and $R_{22}$ has a sulfo group or a carboxyl group; $L_1$ and $L_2$ are each represents a methine group; $n_{11}$ represents 0, 1 or 2; and Z represents a group for necessary for satisfying the charge balance of the compound of the formula, and when the compound has no Z, it forms an internal salt.

3. The positive-positive silver halide color photographic material as claimed in claim 1, wherein the following relationship is satisfied:

$$(\lambda_{smax-0.1})-(\lambda_{smax-0.6})<30 \text{ nm}$$

where $\lambda_{smax}$ represents a wavelength at the spectral maximum sensitivity, Smax, in the red-sensitive emulsion layer, $\lambda_{smax-0.1}$ represents a wavelength in the short wave length side in which the sensitivity is lower than that of $\lambda_{smax}$ by 0.1, and $\lambda_{smax-0.6}$ represents a wavelength in the short wave length side in which the sensitivity is lower than that of $\lambda_{smax}$ by 0.6.

4. The positive-positive silver halide color photographic material as claimed in claim 3, wherein the relationship is $(\lambda_{smax-0.1})-(\lambda_{smax-0.6})<20$ nm.

* * * * *